US011661235B2

(12) United States Patent
Allegretti et al.

(10) Patent No.: US 11,661,235 B2
(45) Date of Patent: May 30, 2023

(54) BULK MATERIAL SHIPPING CONTAINER TOP WALL ASSEMBLY AND BULK MATERIAL SHIPPING CONTAINER HAVING A TOP WALL ASSEMBLY

(71) Applicant: SANDBOX LOGISTICS, LLC, Houston, TX (US)

(72) Inventors: C. John Allegretti, Barrington Hills, IL (US); Kevin Sylvester Corrigan, Forest Park, IL (US); Daniel J. Falce, North Canton, OH (US)

(73) Assignee: SANDBOX ENTERPRISES, LLC, Katy, TX (US)

( * ) Notice: Subject to any disclaimer, the term of this patent is extended or adjusted under 35 U.S.C. 154(b) by 0 days.

(21) Appl. No.: 16/160,510

(22) Filed: Oct. 15, 2018

(65) Prior Publication Data

US 2020/0115100 A1 Apr. 16, 2020

(51) Int. Cl.

| | |
|---|---|
| ***B65D 19/16*** | (2006.01) |
| ***B65D 88/02*** | (2006.01) |
| ***B65D 90/62*** | (2006.01) |
| ***B65D 21/08*** | (2006.01) |
| ***B65D 90/00*** | (2006.01) |

(52) U.S. Cl.

CPC ..... *B65D 19/16* (2013.01); *B65D 88/022* (2013.01); *B65D 90/62* (2013.01); *B65D 21/08* (2013.01); *B65D 90/0033* (2013.01); *B65D 2519/00029* (2013.01); *B65D 2519/00064* (2013.01); *B65D 2519/00134* (2013.01); *B65D 2519/00169* (2013.01); *B65D 2519/00203* (2013.01); *B65D 2519/00238* (2013.01); *B65D 2519/00273* (2013.01); *B65D 2519/00721* (2013.01); *B65D 2519/00955* (2013.01)

(58) Field of Classification Search

CPC ..... B65D 19/16; B65D 88/022; B65D 90/62; B65D 21/08; B65D 90/0033; B65D 2519/00273; B65D 2519/00721; B65D 2519/00955; B65D 2519/00029; B65D 2519/00203; B65D 2519/00064; B65D 2519/00238; B65D 2519/00134; B65D 2519/00169

USPC ..... 206/386

See application file for complete search history.

(56) References Cited

U.S. PATENT DOCUMENTS

| | | | |
|---|---|---|---|
| 572,468 | A | 12/1896 | Brown |
| 710,611 | A | 10/1902 | Ray |
| 917,646 | A | 4/1909 | Otto |
| 917,649 | A | 4/1909 | Otto |
| 2,385,245 | A | 9/1945 | Willoughby |

(Continued)

FOREIGN PATENT DOCUMENTS

| | | |
|---|---|---|
| DE | 4008147 | 9/1990 |
| EP | 0016977 | 10/1980 |

(Continued)

*Primary Examiner* — J. Gregory Pickett
*Assistant Examiner* — Jenine Pagan
(74) *Attorney, Agent, or Firm* — Osha Bergman Watanabe & Burton LLP

(57) ABSTRACT

Various embodiments provide a bulk material shipping container top wall assembly, and a bulk material shipping container including the top wall assembly, that provides various advantages over previously known commercially available bulk shipping material container top wall assemblies and bulk shipping material containers.

20 Claims, 19 Drawing Sheets

(56) References Cited

U.S. PATENT DOCUMENTS 2,462,693 A 2/1949 Wabshaw
2,563,470 A 8/1951 Kane
2,622,771 A 12/1952 Tulou
2,652,174 A 9/1953 Shea et al.
2,670,866 A 3/1954 Glesby
2,678,737 A 5/1954 Mangrum
2,802,603 A 8/1957 McCray
2,865,521 A 12/1958 Fisher et al.
2,894,666 A 7/1959 Campbell, Jr.
3,049,248 A 8/1962 Heltzel et al.
3,083,879 A 4/1963 Coleman
3,151,779 A 10/1964 Rensch et al.
3,270,921 A 9/1966 Nadolske
3,294,306 A 12/1966 Areddy
3,318,473 A 5/1967 Jones et al.
3,343,688 A 9/1967 Ross
3,406,995 A 10/1968 McCarthy
3,407,971 A 10/1968 Oehler
3,476,270 A 11/1969 Cox et al.
3,595,424 A * 7/1971 Jackson ..... F17C 3/025 220/562
3,602,400 A 8/1971 Cooke
3,752,511 A 8/1973 Racy
3,785,534 A 1/1974 Smith
3,797,727 A 3/1974 Downing et al.
3,800,970 A * 4/1974 Jackson ..... B65D 90/023 220/560.08
3,802,584 A 4/1974 Sackett, Sr. et al.
3,904,105 A 9/1975 Booth
3,955,703 A 5/1976 Zebarth
3,986,708 A 10/1976 Heltzel et al.
3,999,290 A 12/1976 Wood
4,019,634 A 4/1977 Bonnot
4,019,635 A 4/1977 Boots
4,023,719 A 5/1977 Noyon
4,056,295 A 11/1977 Downing
4,058,239 A 11/1977 Van Mill
4,138,163 A 2/1979 Calvert et al.
4,178,117 A 12/1979 Brugler
4,204,773 A 5/1980 Bates
4,247,228 A 1/1981 Gray et al.
4,258,953 A 3/1981 Johnson
4,280,640 A 7/1981 Daloisio
4,282,988 A 8/1981 Hulbert, Jr.
4,313,708 A 2/1982 Tiliakos
4,331,252 A 5/1982 Carren
4,397,406 A 8/1983 Croley
4,398,653 A 8/1983 Daloisio
4,448,296 A 5/1984 Tabler
4,466,541 A 8/1984 Tabler et al.
4,470,518 A 9/1984 Stein
4,485,910 A 12/1984 Tabler
4,572,368 A 2/1986 Miller et al.
4,573,577 A 3/1986 Miller
4,574,962 A 3/1986 Tabler et al.
4,600,103 A 7/1986 Tabler
D285,219 S 8/1986 Stein
4,620,644 A 11/1986 Miller
4,626,166 A 12/1986 Jolly
4,643,310 A 2/1987 Deaton et al.
4,648,199 A 3/1987 Deaton et al.
4,648,200 A 3/1987 Miller et al.
D289,788 S 5/1987 Deaton et al.
D290,778 S 7/1987 Tabler
4,688,675 A 8/1987 Miller et al.
4,701,095 A 10/1987 Berryman et al.
D292,718 S 11/1987 Stein
4,724,976 A 2/1988 Lee
4,756,420 A 7/1988 Deaton
4,760,922 A 8/1988 Northgrave
4,779,751 A 10/1988 Munroe
4,804,082 A 2/1989 Stein
4,809,851 A 3/1989 Oestreich, Jr. et al.
4,832,200 A 5/1989 Deaton et al.
RE32,966 E 6/1989 Miller et al.
4,848,605 A 7/1989 Wise
4,856,681 A 8/1989 Murray
D304,120 S 10/1989 Buchanan et al.
4,890,740 A 1/1990 Tabler
4,917,255 A 4/1990 Foy et al.
4,919,583 A 4/1990 Speakman, Jr.
D307,718 S 5/1990 Tabler
4,936,458 A 6/1990 Tabler et al.
4,946,068 A 8/1990 Erickson et al.
4,948,186 A 8/1990 Pruitt
4,956,821 A 9/1990 Fenelon
RE33,384 E 10/1990 Miller et al.
4,960,207 A 10/1990 Tabler et al.
4,966,310 A 10/1990 Hawkins
4,974,737 A 12/1990 Miller
4,993,883 A 2/1991 Jones
4,995,522 A 2/1991 Barr
5,036,979 A 8/1991 Selz
5,094,356 A 3/1992 Miller
5,096,096 A 3/1992 Calaunan
5,201,432 A * 4/1993 Elvin-Jensen ..... B65D 19/04 220/1.5
5,224,635 A 7/1993 Wise
5,232,120 A 8/1993 Dunken et al.
5,269,455 A 12/1993 Grigsby et al.
5,277,014 A 1/1994 White
5,290,139 A 3/1994 Hedrick
5,330,069 A 7/1994 Jamison et al.
5,339,996 A 8/1994 Dubbert et al.
5,373,961 A 12/1994 Harris et al.
5,375,730 A 12/1994 Bahr et al.
5,392,946 A 2/1995 Holbrook et al.
5,402,915 A 4/1995 Hogan
5,413,154 A 5/1995 Hurst, Jr. et al.
5,439,113 A 8/1995 Elvin-Jensen
5,441,321 A 8/1995 Karpisek
5,445,289 A 8/1995 Owen
5,524,750 A 6/1996 Miller
5,564,599 A 10/1996 Barber et al.
5,667,090 A 9/1997 Langham, Jr. et al.
5,673,791 A 10/1997 Jamison
5,715,962 A 2/1998 McDonnell
5,722,550 A 3/1998 Ficker
5,722,552 A 3/1998 Olson
5,788,121 A 8/1998 Sasaki et al.
5,803,296 A 9/1998 Olson
5,829,616 A 11/1998 Daniel et al.
5,836,480 A 11/1998 Epp et al.
5,845,799 A 12/1998 Deaton
5,878,903 A 3/1999 Ung
5,927,356 A 7/1999 Henderson
5,927,558 A 7/1999 Bruce
5,960,974 A 10/1999 Kee et al.
5,971,219 A 10/1999 Karpisek
5,997,099 A 12/1999 Collins
6,010,022 A 1/2000 Deaton
6,059,372 A 5/2000 McDonald et al.
6,112,929 A 9/2000 Ota
6,205,938 B1 3/2001 Foley et al.
6,247,594 B1 6/2001 Garton
6,253,948 B1 7/2001 Ficker
6,328,183 B1 12/2001 Coleman
6,491,343 B2 12/2002 Yamazaki
6,537,015 B2 3/2003 Lim et al.
6,547,127 B2 4/2003 Bradford et al.
6,568,567 B2 5/2003 McKenzie et al.
6,622,849 B1 9/2003 Sperling
6,776,300 B2 8/2004 Walsh et al.
6,783,032 B2 8/2004 Fons
6,902,061 B1 * 6/2005 Elstone ..... B65D 19/02 206/596
6,968,946 B2 11/2005 Shuert
7,008,163 B2 3/2006 Russell
7,032,765 B2 4/2006 Miller et al.
7,100,791 B2 9/2006 Berger
7,100,896 B1 9/2006 Cox
7,240,681 B2 7/2007 Saik
7,252,309 B2 8/2007 Eng Soon et al.
7,284,579 B2 10/2007 Elgan et al.

(56) References Cited

U.S. PATENT DOCUMENTS 7,353,962 B2 4/2008 Parnall et al.
D575,062 S 8/2008 Wolf
7,431,173 B2 10/2008 Thorpe
7,475,796 B2 1/2009 Garton
7,500,817 B2 3/2009 Furner et al.
7,543,539 B2 6/2009 Miller
7,556,166 B2 7/2009 Parnall et al.
7,762,281 B2 7/2010 Schuld
8,201,520 B2 6/2012 Meritt
8,387,824 B2 3/2013 Wietgrefe
8,434,990 B2 5/2013 Claussen
D688,349 S 8/2013 Oren et al.
D688,350 S 8/2013 Oren et al.
D688,351 S 8/2013 Oren et al.
D688,772 S 8/2013 Oren et al.
8,505,780 B2 8/2013 Oren
8,545,148 B2 10/2013 Wanek-Pusset et al.
8,573,917 B2 11/2013 Renyer
8,585,341 B1 11/2013 Oren et al.
8,607,289 B2 12/2013 Brown et al.
8,616,370 B2 12/2013 Allegretti et al.
8,622,251 B2 1/2014 Oren
8,668,430 B2 3/2014 Oren et al.
D703,582 S 4/2014 Oren
8,827,118 B2 9/2014 Oren
8,887,914 B2 11/2014 Allegretti et al.
8,915,691 B2 12/2014 Mintz
RE45,713 E 10/2015 Oren et al.
9,162,603 B2 10/2015 Oren
RE45,788 E 11/2015 Oren et al.
9,248,772 B2 2/2016 Oren
RE45,914 E 3/2016 Oren et al.
9,296,518 B2 3/2016 Oren
9,309,064 B2 4/2016 Sheesley
9,340,353 B2 5/2016 Oren et al.
9,358,916 B2 6/2016 Oren
9,394,102 B2 7/2016 Oren et al.
9,403,626 B2 8/2016 Oren
9,421,899 B2 8/2016 Oren
9,440,785 B2 9/2016 Oren et al.
9,446,801 B1 9/2016 Oren
9,475,661 B2 10/2016 Oren
9,511,929 B2 12/2016 Oren
9,522,816 B2 12/2016 Taylor
9,527,664 B2 12/2016 Oren
9,580,238 B2 2/2017 Friesen et al.
RE46,334 E 3/2017 Oren et al.
D780,883 S 3/2017 Schaffner et al.
D783,771 S 4/2017 Stegemoeller et al.
D783,772 S 4/2017 Stegemoeller, III et al.
9,617,065 B2 4/2017 Allegretti et al.
9,617,066 B2 4/2017 Oren
9,624,030 B2 4/2017 Oren et al.
9,624,036 B2 4/2017 Luharuka et al.
9,643,774 B2 5/2017 Oren
9,650,216 B2 5/2017 Allegretti
9,656,799 B2 5/2017 Oren et al.
9,669,993 B2 6/2017 Oren et al.
9,670,752 B2 6/2017 Glynn et al.
9,676,554 B2 6/2017 Glynn et al.
9,682,815 B2 6/2017 Oren
9,694,970 B2 7/2017 Oren et al.
9,701,463 B2 7/2017 Oren et al.
9,718,609 B2 8/2017 Oren et al.
9,718,610 B2 8/2017 Oren
9,725,233 B2 8/2017 Oren et al.
9,725,234 B2 8/2017 Oren et al.
9,738,439 B2 8/2017 Oren et al.
RE46,531 E 9/2017 Oren et al.
9,758,081 B2 9/2017 Oren
9,758,993 B1 9/2017 Allegretti et al.
9,771,224 B2 9/2017 Oren et al.
9,783,338 B1 10/2017 Allegretti et al.
9,796,504 B1 10/2017 Allegretti et al.
9,828,135 B2 11/2017 Allegretti et al.
2001/0022308 A1 9/2001 Epp et al.
2002/0023994 A1 2/2002 De Shann
2002/0070215 A1 6/2002 Walsh et al.
2003/0019875 A1 1/2003 Woram
2003/0024971 A1 2/2003 Jones et al.
2004/0074922 A1 4/2004 Bothor et al.
2004/0118725 A1 6/2004 Shuert
2004/0222222 A1 11/2004 Parnall et al.
2004/0232146 A1 11/2004 Kessler et al.
2006/0266747 A1 11/2006 Stolzman
2007/0210080 A1 9/2007 Hooper
2007/0241104 A1 10/2007 Huizingh et al.
2007/0278223 A1 12/2007 Ficker
2007/0290471 A1 12/2007 Sexton
2008/0029546 A1 2/2008 Schuld
2008/0029553 A1 2/2008 Culleton
2008/0169285 A1 7/2008 Marazita et al.
2008/0179054 A1 7/2008 McGough et al.
2008/0179322 A1 7/2008 Parnall et al.
2008/0179324 A1 7/2008 McGough et al.
2008/0226434 A1* 9/2008 Smith ..... B65D 88/022 414/332
2009/0000527 A1 1/2009 Ficker
2009/0078410 A1 3/2009 Krenek et al.
2009/0129903 A1 5/2009 Lyons, III
2009/0314791 A1* 12/2009 Hartley ..... B65D 90/0033 220/751
2011/0011893 A1 1/2011 Cerny
2011/0155610 A1* 6/2011 Carver, III ..... B65D 11/1873 206/503
2011/0168593 A1 7/2011 Neufeld et al.
2012/0017812 A1 1/2012 Renyer et al.
2012/0085756 A1* 4/2012 Beitler ..... B65D 88/128 220/1.5
2012/0102848 A1 5/2012 Atiyeh et al.
2013/0206415 A1 8/2013 Sheesley
2013/0209204 A1 8/2013 Sheesley
2014/0023463 A1 1/2014 Oren
2014/0083554 A1 3/2014 Harris
2014/0305769 A1 10/2014 Eiden, III et al.
2015/0003955 A1 1/2015 Oren et al.
2015/0284194 A1 10/2015 Oren et al.
2015/0360856 A1* 12/2015 Oren ..... B65G 65/42 414/411
2015/0375930 A1 12/2015 Oren et al.
2016/0031658 A1 2/2016 Oren et al.
2016/0039433 A1 2/2016 Oren et al.
2016/0046438 A1 2/2016 Oren et al.
2016/0046454 A1 2/2016 Oren et al.
2016/0068342 A1 3/2016 Oren et al.
2016/0130095 A1 5/2016 Oren et al.
2016/0244279 A1 8/2016 Oren et al.
2016/0264352 A1 9/2016 Oren
2016/0332809 A1 11/2016 Harris
2016/0332811 A1 11/2016 Harris
2017/0129696 A1 5/2017 Oren
2017/0144834 A1 5/2017 Oren et al.
2017/0190523 A1 7/2017 Oren et al.
2017/0203915 A1 7/2017 Oren
2017/0225883 A1 8/2017 Oren
2017/0240350 A1 8/2017 Oren et al.
2017/0240361 A1 8/2017 Glynn et al.
2017/0240363 A1 8/2017 Oren
2017/0267151 A1 9/2017 Oren
2017/0283165 A1 10/2017 Oren et al.
2018/0002066 A1 1/2018 Allegretti et al.
2018/0002120 A1 1/2018 Allegretti et al.

FOREIGN PATENT DOCUMENTS

EP 1598288 11/2005
EP 2937826 10/2015
FR 2640598 6/1990
GB 2066220 7/1981
GB 2204847 11/1988
JP 2007084151 4/2007
JP 2008239019 10/2008
NL 8105283 6/1983

(56) References Cited

FOREIGN PATENT DOCUMENTS

| | | |
|---|---|---|
| WO | WO01076960 | 10/2001 |
| WO | WO03024815 | 3/2003 |
| WO | WO2007/010262 | 1/2007 |
| WO | WO2007081556 | 7/2007 |
| WO | WO2008012513 | 1/2008 |
| WO | WO2009087338 | 7/2009 |
| WO | WO2013095871 | 6/2013 |
| WO | WO2013142421 | 9/2013 |
| WO | WO2014018129 | 1/2014 |
| WO | WO2014018236 | 1/2014 |
| WO | WO2015119799 | 8/2015 |
| WO | WO2015191150 | 12/2015 |
| WO | WO2015192061 | 12/2015 |
| WO | WO2016044012 | 3/2016 |
| WO | WO2016160067 | 10/2016 |
| WO | WO2016178691 | 11/2016 |
| WO | WO2016178692 | 11/2016 |
| WO | WO2016178694 | 11/2016 |
| WO | WO2016178695 | 11/2016 |
| WO | WO2017014768 | 1/2017 |
| WO | WO2017014771 | 1/2017 |
| WO | WO2017014774 | 1/2017 |
| WO | WO2017027034 | 2/2017 |
| WO | WO2017095423 | 6/2017 |

* cited by examiner 212
224
900
200
300
214
100
501

210

900
222
200
300
212
50
100

214
900
226
200
300
216
50
100

BULK MATERIAL SHIPPING CONTAINER TOP WALL ASSEMBLY AND BULK MATERIAL SHIPPING CONTAINER HAVING A TOP WALL ASSEMBLY

BACKGROUND

Various bulk material shipping containers are known. Various known bulk material shipping containers are used to transport a wide range of products, parts, components, items, and other materials such as, but not limited to, seeds, shavings, fasteners, dry bulk, plastic resins, and granular materials (such as but not limited to cement or sand). These materials are generally referred to as loose materials herein.

There is a continuing need for better bulk material shipping containers for loose materials that are stronger than various known bulk material shipping containers, more durable than various known bulk material shipping containers, lighter than various known containers (that having similar loose material volume and weight capacities), easier to construct than various known bulk material shipping containers, configured to hold greater volumes of loose materials than various known bulk material shipping containers, configured to hold greater weights of loose materials than various known bulk material shipping containers, and configured to have a better weight to holding cargo capacity than various known bulk material shipping containers.

SUMMARY

Various embodiments of the present disclosure provide a bulk material shipping container top wall assembly, and a bulk material shipping container including the top wall assembly, that provides various advantages over previously known commercially available bulk shipping material container top wall assemblies and bulk shipping material containers.

Various embodiments of the bulk material shipping container top wall assembly include: (1) a molded unitary (or one-piece) outer structure; and (2) a relatively lightweight and relatively strong inner reinforcing structure. The top wall assembly is configured to be mounted on and co-act with the other components of a bulk material shipping container to provide an inner chamber for holding loose materials.

Various embodiments of the bulk material shipping container of the present disclosure include: (1) a pallet; (2) a compartment connected to and supported by the pallet (such as via hopper supports), and which includes the top wall assembly; (3) a material unloading assembly connected to and supported by the pallet and positioned at a bottom portion of the compartment; and (4) a material loading assembly connected to and supported by the top wall assembly of the compartment.

In various embodiments, the bulk material shipping container with the top wall assembly is: (1) lighter than various known bulk material shipping containers; (2) stronger than various known bulk material shipping containers; (3) more durable than various known bulk material shipping containers; (4) configured to hold greater weights of loose materials than various known bulk material shipping containers; (5) configured to have a better weight to holding cargo capacity than various known bulk material shipping containers; (6) configured to better prevent leakage or water egress into the compartment than various known bulk material shipping containers; and (7) easier to assemble than various known bulk material shipping containers.

For purposes of brevity, (1) the bulk material shipping container of the present disclosure may sometimes be referred to herein as a material shipping container, a shipping container, or simply as a container; (2) a person who uses the container may sometimes be referred to herein as a "user" or an "operator"; (3) a person who loads loose materials in a container may sometimes be referred to herein as a "loader"; and (4) a person who removes the loose materials from a container may sometimes be referred to herein as an "unloader."

Additional features and advantages of the present disclosure are described in and will be apparent from the following figures and Detailed Description of Exemplary Embodiments.

DETAILED DESCRIPTION OF EXEMPLARY EMBODIMENTS

Figure 1:
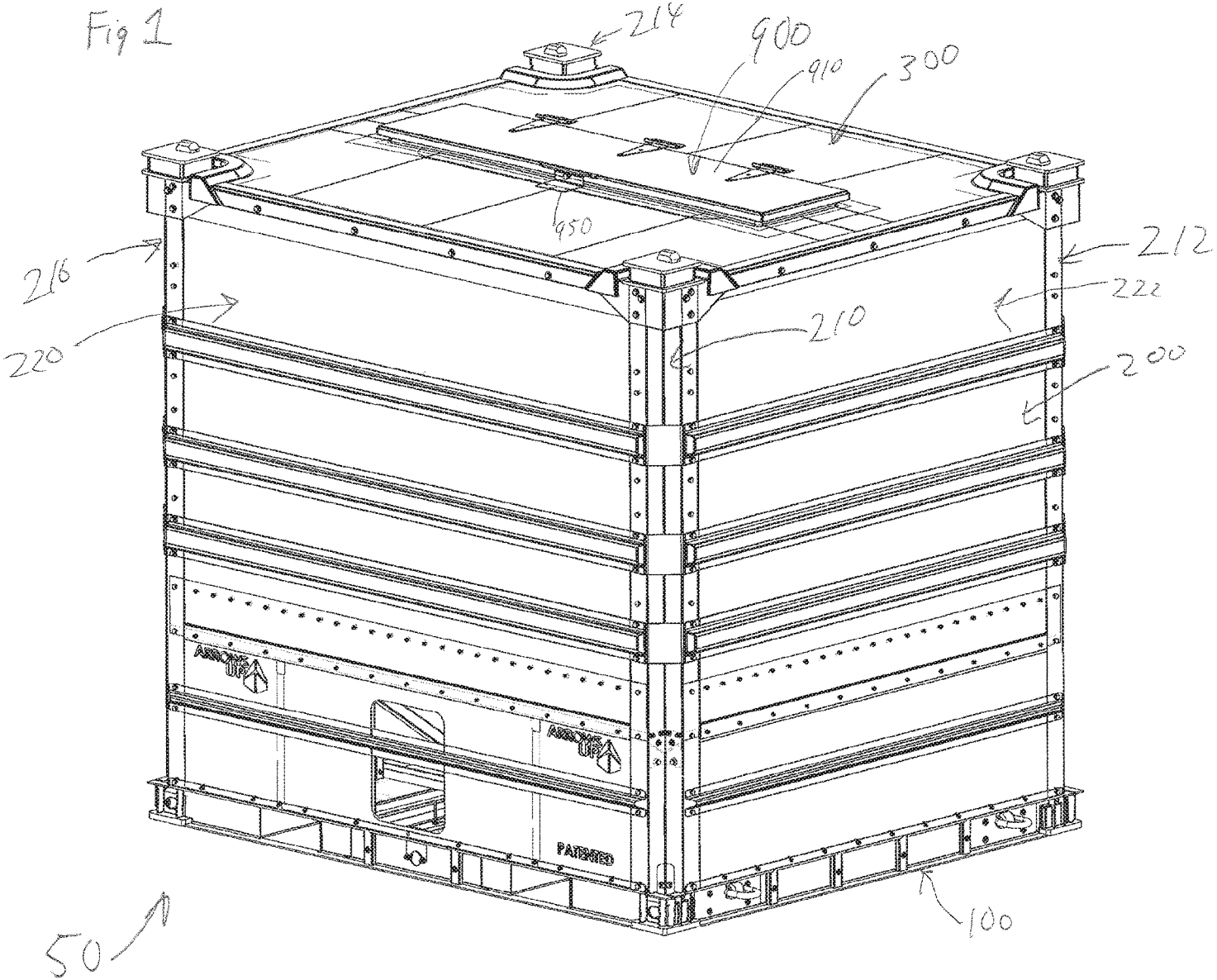
FIG. 1 is a top front perspective view of the bulk material shipping container of one example embodiment of the present disclosure, and illustrating an example embodiment of the improved top wall assembly of the present disclosure.
Figure 2:
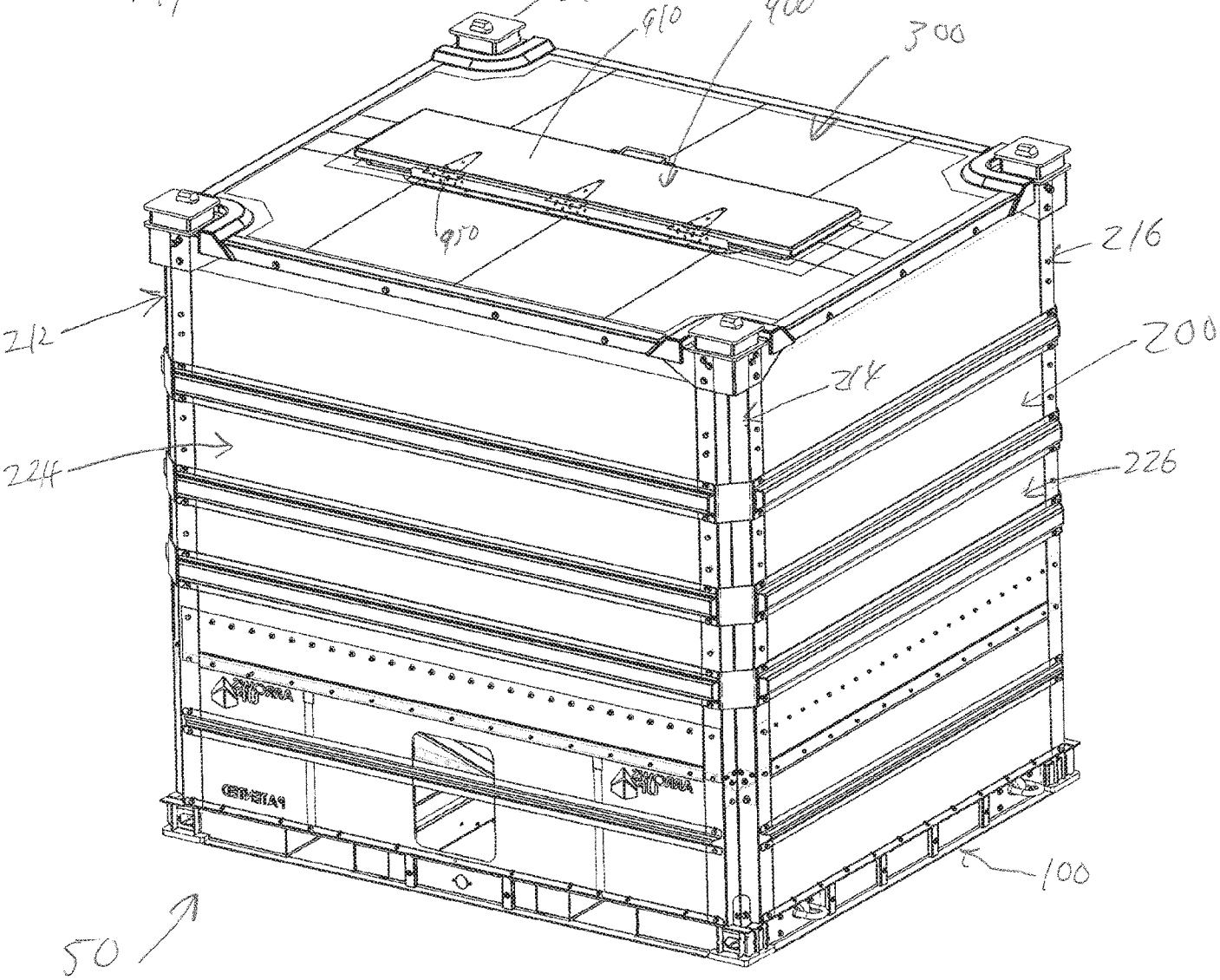
FIG. 2 is a top rear perspective view of the bulk material shipping container of FIG. 1.
Figure 3:
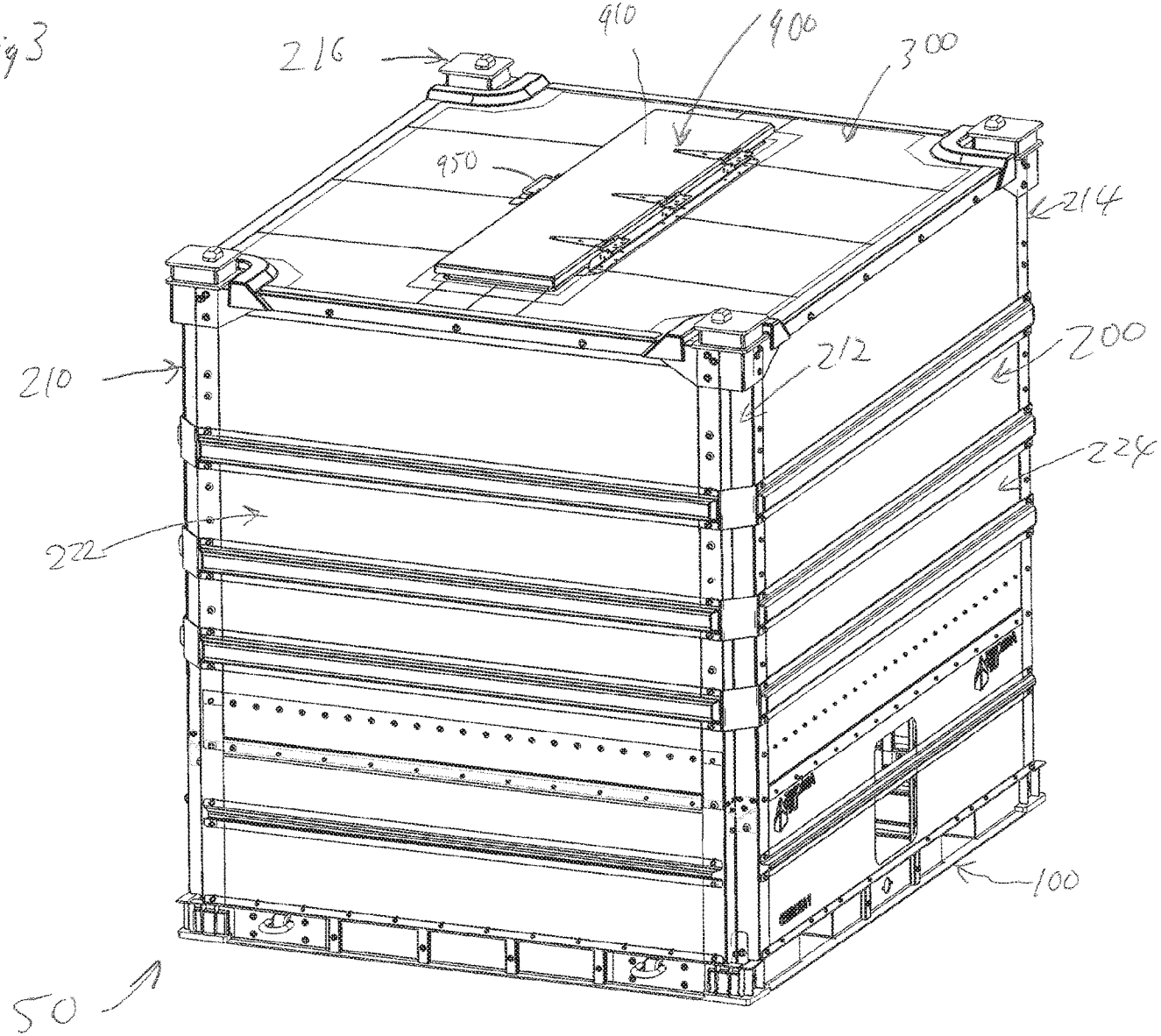
FIG. 3 is a top side perspective view of the bulk material shipping container of FIG. 1.
Figure 4:
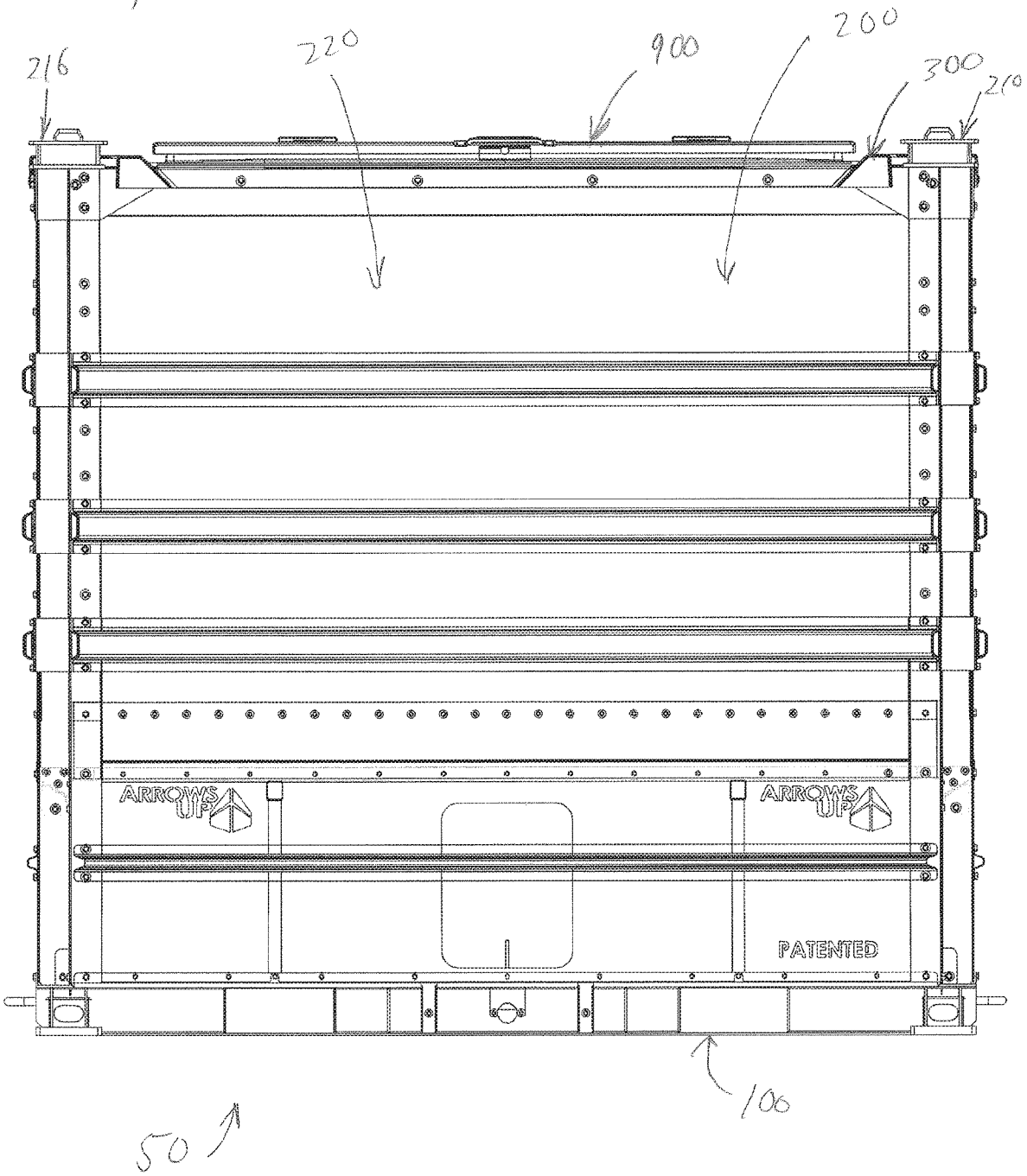
FIG. 4 is a front view of the bulk material shipping container of FIG. 1.
Figure 5:
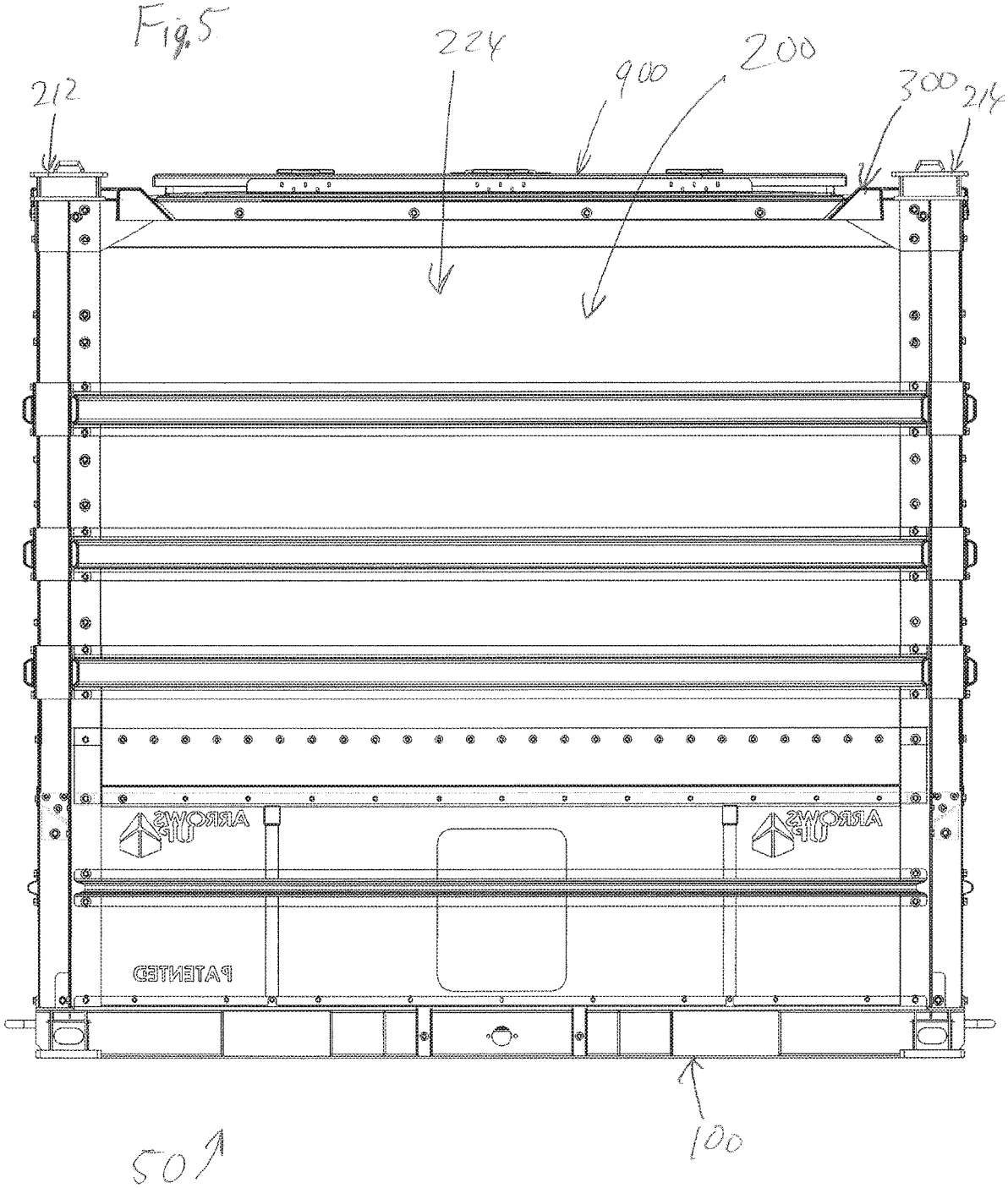
FIG. 5 is a rear view of the bulk material shipping container of FIG. 1.
Figure 6:
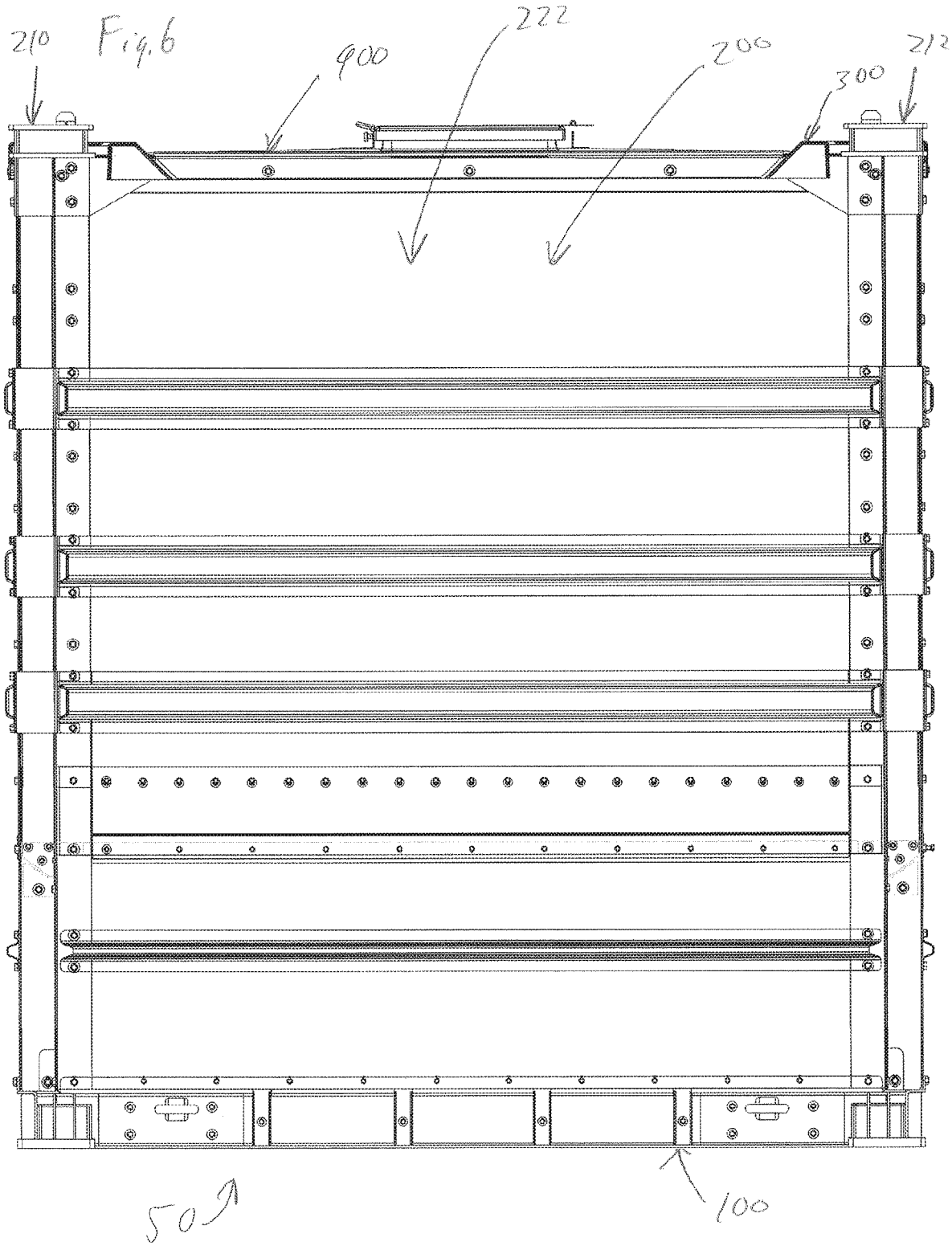
FIG. 6 is a right side view of the bulk material shipping container of FIG. 1.
Figure 7:
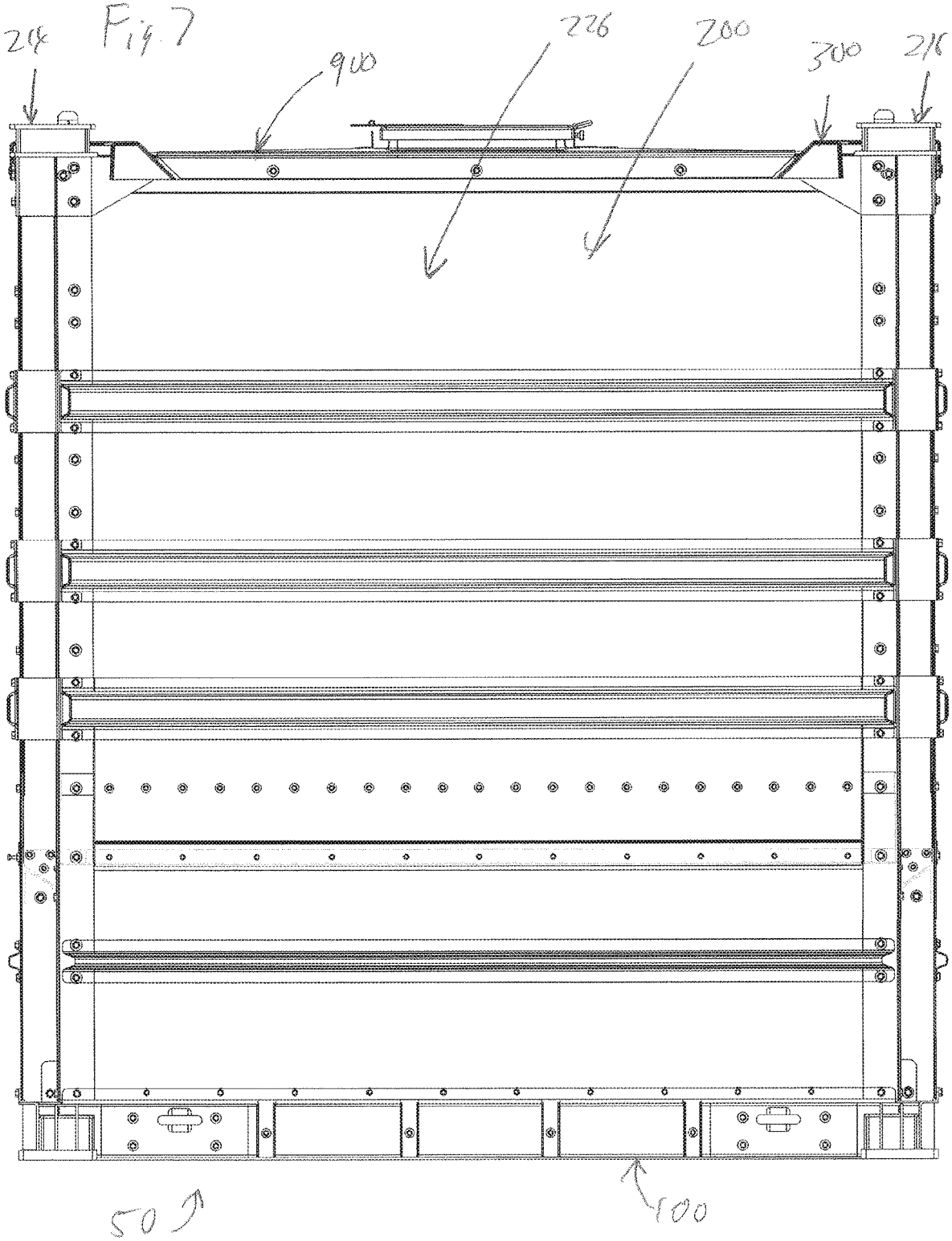
FIG. 7 is a left side view of the bulk material shipping container of FIG. 1.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

As further explained below, in various embodiments, the bulk material shipping container of the present disclosure provides an improved bulk material shipping container for loose materials that includes a compartment having a top wall assembly of the present disclosure that includes an outer unitary (or one-piece) top wall and a relatively lightweight relatively strong inner reinforcing structure and that is configured to co-act with the other components of the compartment. The top wall assembly enables the compartment and the overall shipping container to be: (1) lighter than various known bulk material shipping containers; (2) stronger than various known bulk material shipping containers; (3) more durable than various known bulk material shipping containers; (4) configured to hold greater weights of loose materials than various known bulk material shipping containers; (5) configured to have a better weight to holding cargo capacity than various known bulk material shipping containers; (6) configured to better prevent leakage or water egress into the compartment than various known bulk material shipping containers; and (7) easier to assemble than various known bulk material shipping containers.

Referring now to the drawings, FIGS. 1 to 19 illustrate one example embodiment of a bulk material shipping container of the present disclosure and including one example embodiment of a top wall assembly of the present disclosure. This example bulk material shipping container, which is generally indicated by numeral 50, is configured to receive, hold, and release loose materials of substantial weight and volume.

Generally, as shown in FIGS. 1 to 19, this illustrated example embodiment of the shipping container 50 of the present disclosure includes: (1) a pallet 100; (2) a compartment 200 connected to and supported by the pallet 100, and including a top wall assembly 300; (3) a material unloading assembly 800 connected to and supported by the pallet and the compartment 200, and positioned at bottom portion of the compartment 200; and (4) a material loading assembly 900 connected to and supported by the top wall assembly 300 of the compartment 200. The pallet 100 is configured to facilitate movement of the container 50 and to facilitate stacking of multiple containers 50. The compartment 200 is configured to receive, hold, and release loose materials. The material unloading assembly 800 is configured to facilitate the release or unloading of loose materials from the compartment 200 of the container 50. The material loading assembly 900 is configured to facilitate the loading of loose material into the compartment 200 and to prevent contaminants from entering the compartment 200. It should be appreciated that the material shipping container 50 generally includes a front side (shown in FIGS. 1, 3, 4, and 9), a rear or back side (shown in FIGS. 2, 5, and 9) that is opposite the front side, a right side (shown in FIGS. 1, 3, 6, and 9), a left side (shown in FIGS. 2, 7, and 9), opposite the right side, a bottom side, and a top side (shown in FIGS. 1, 2, 3, and 9).

More specifically, in this example embodiment of the shipping container 50 of the present disclosure, the pallet 100 is configured to be lifted by a lifting vehicle such as a forklift truck to lift, move, and position or place the container 50 when the container 50 is: (a) manufactured; (b) transported to a material loading facility; (c) at a material loading facility; (d) moved and positioned in or on a transport vehicle at the material loading facility after loading loose materials in the container 50; (e) removed from a transport vehicle at a material unloading facility or storage facility; (f) at a container unloading facility or site or at a storage facility; (g) moved and positioned in or on a material unloading device for storage or emptying or another container at the material unloading facility for storage or emptying; (h) moved into another position or another location for customer storage, use, or emptying; and/or (i) moved and positioned in or on a transport vehicle at the material unloading facility after unloading the materials from the container 50. The container 50 and specifically the pallet 100 of the container 50 is configured to account for the use of forklift trucks that can engage the pallet 100 to: (1) lift the container 50; (2) move the container 50; (3) stack the container 50 on top of another container 50 or other device; (4) un-stack a stacked container 50 from another container 50 or other device; and (5) place the container 50 on a material unloading device (such as one of the example material unloading devices shown in U.S. Pat. No. 9,650,216 or U.S. Published Patent Application No. 2018/0002120). Example pallets for the containers of the present disclosure are described in U.S. Pat. No. 8,887,914 and U.S. Published Patent Application No. 2018/0002066, which are incorporated herein by reference. It should be appreciated that the pallet may be in other suitable forms in accordance with the present disclosure. Thus, the pallet 100 is not described in further detail herein for brevity.

Figure 8:
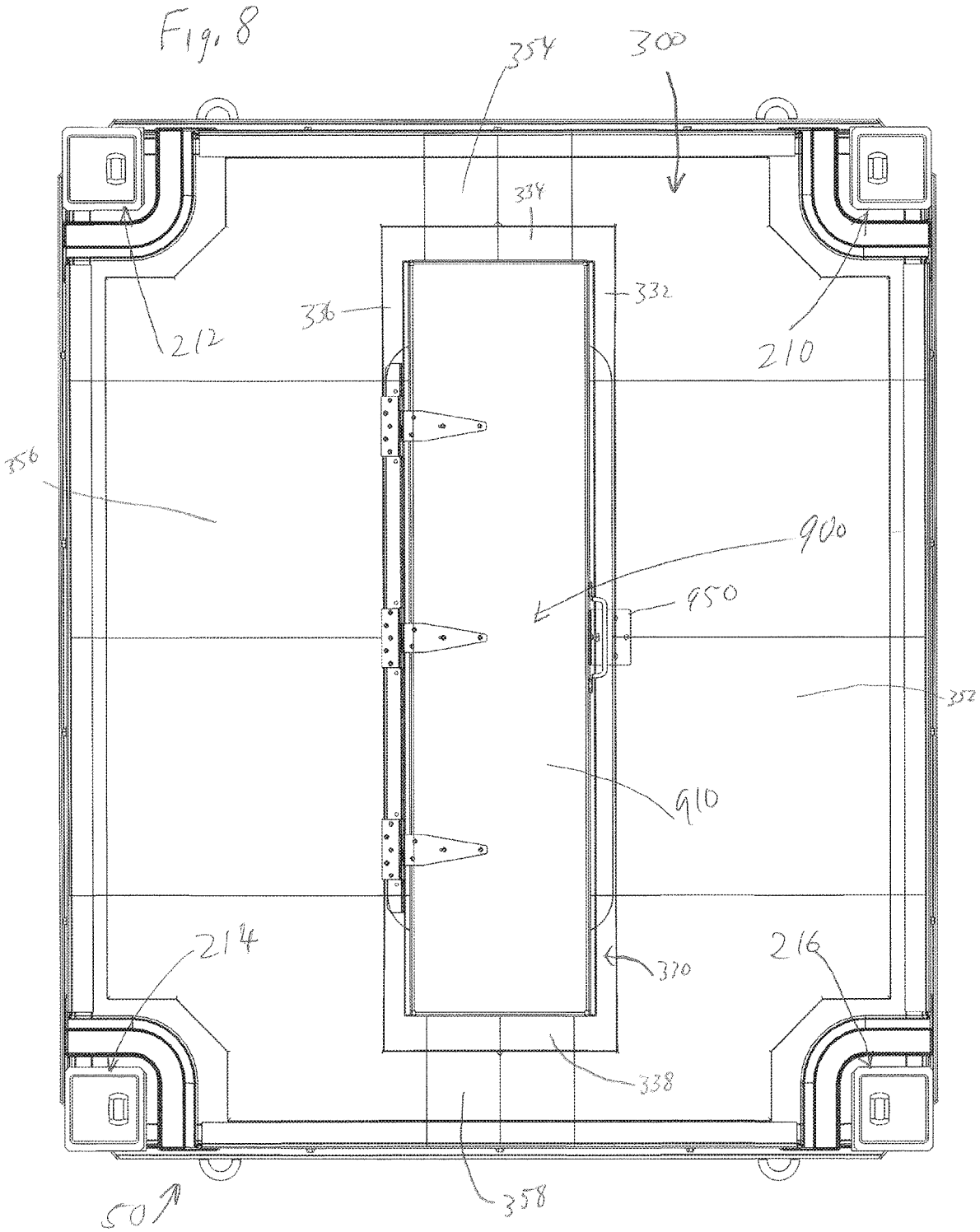
FIG. 8 is a top view of the bulk material shipping container of FIG. 1.
Figure 9:
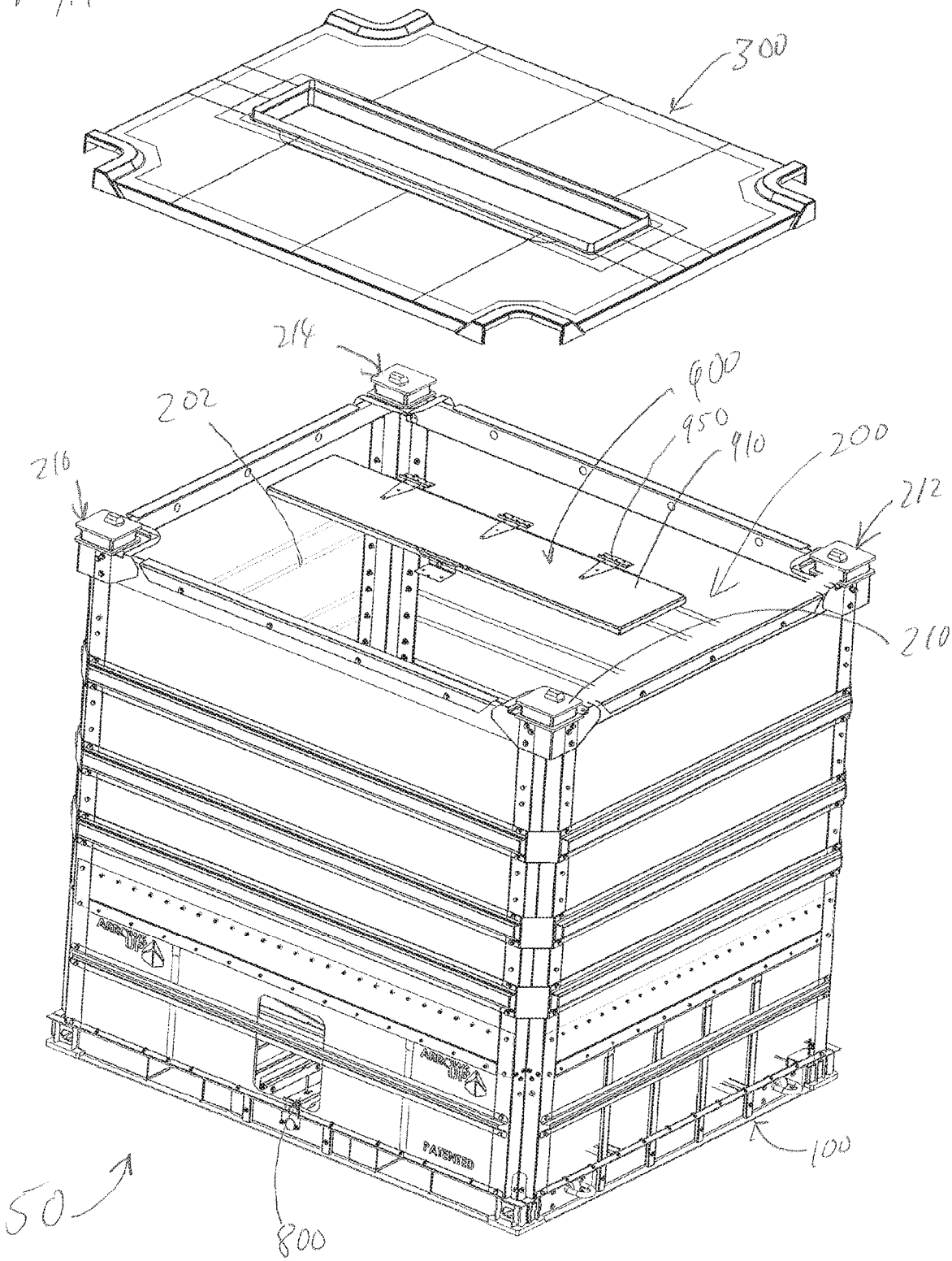
FIG. 9 is a partially exploded top perspective view of the bulk material shipping container of FIG. 1, showing the top wall assembly removed from the rest of the bulk material shipping container of FIG. 1.
Figure 10:
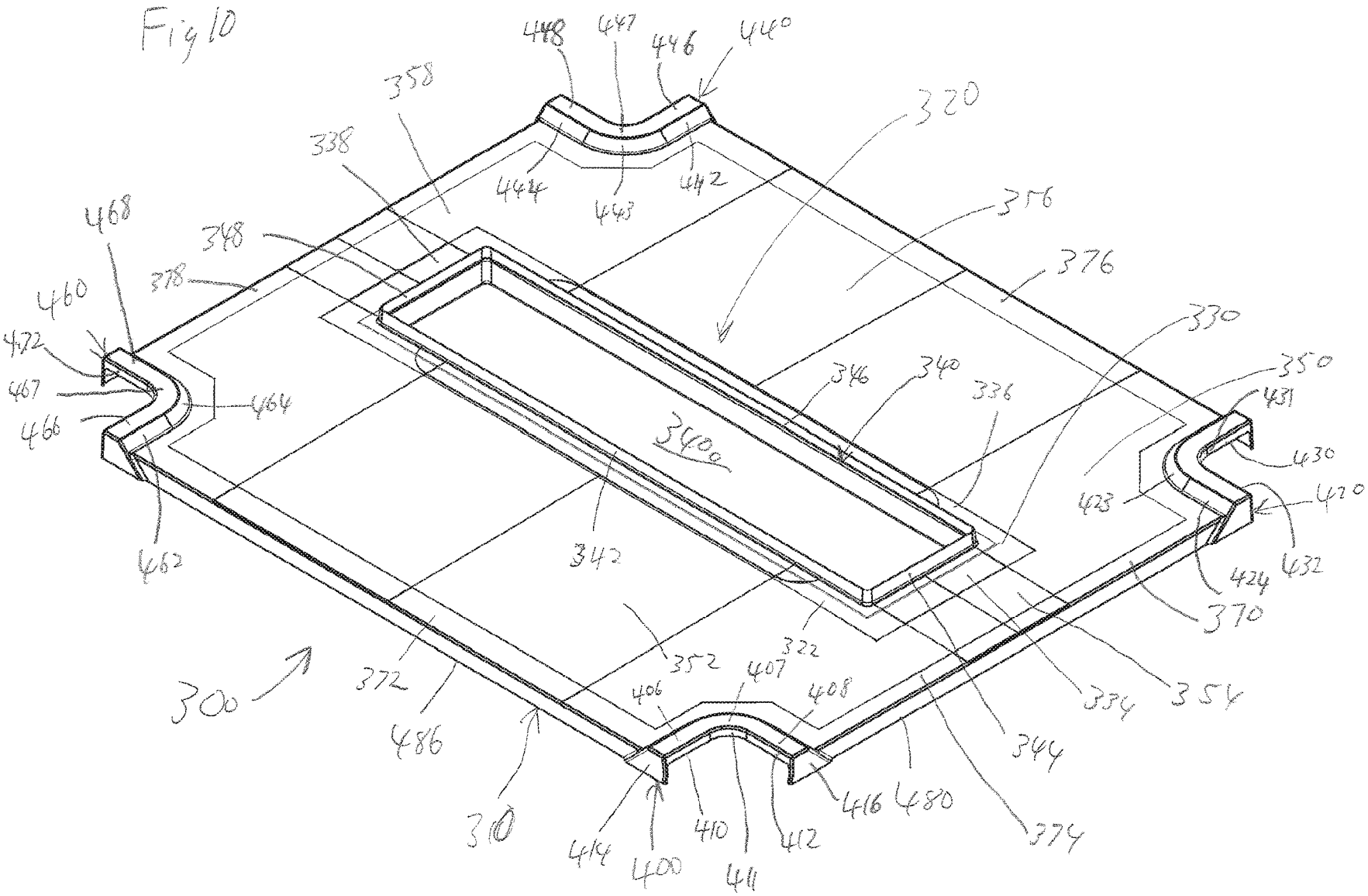
FIG. 10 is an enlarged top perspective view of the top wall assembly removed from the rest of the bulk material shipping container of FIG. 1.
Figure 11:
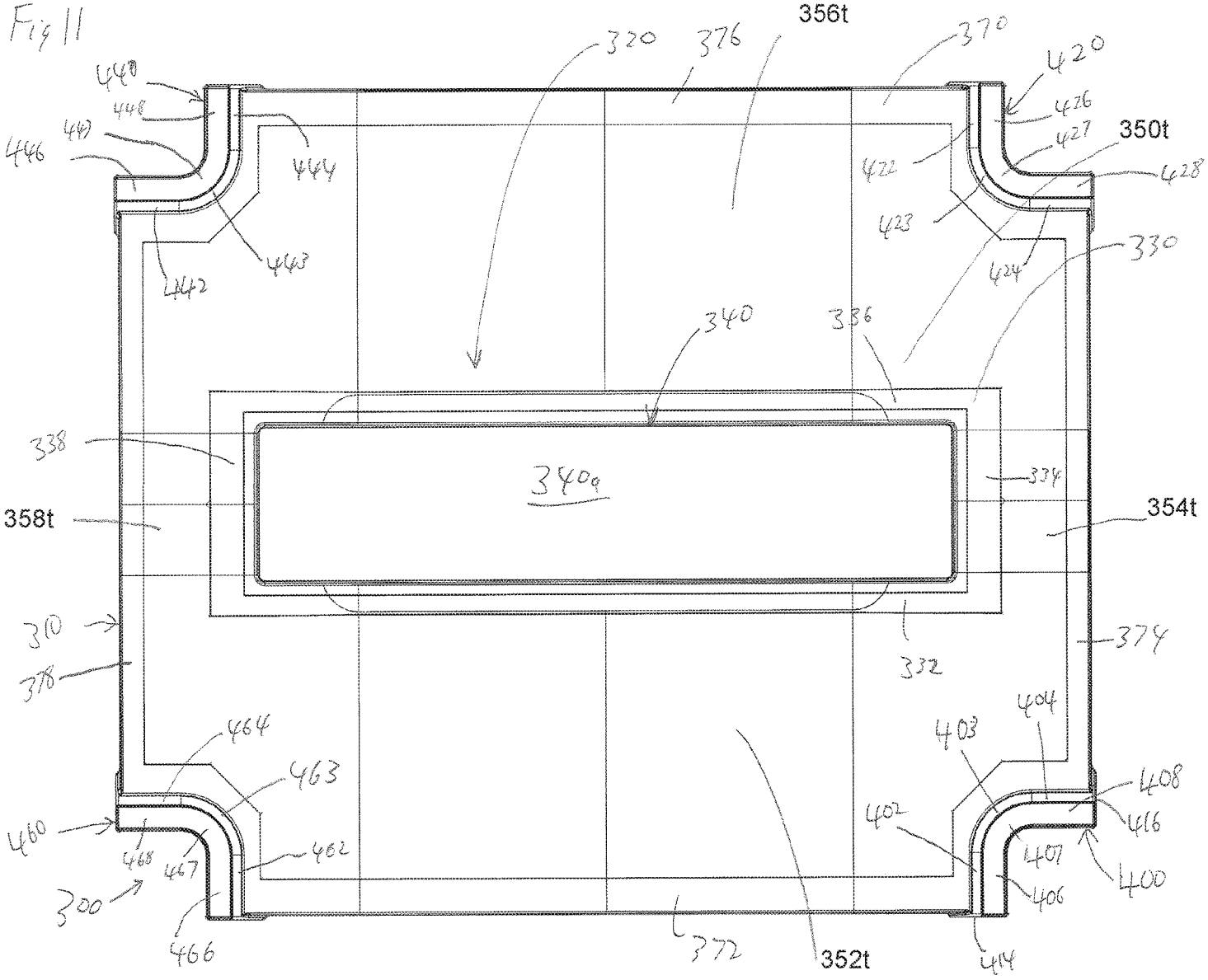
FIG. 11 is an enlarged top view of the top wall assembly removed from the rest of the bulk material shipping container of FIG. 1.
Figure 12:
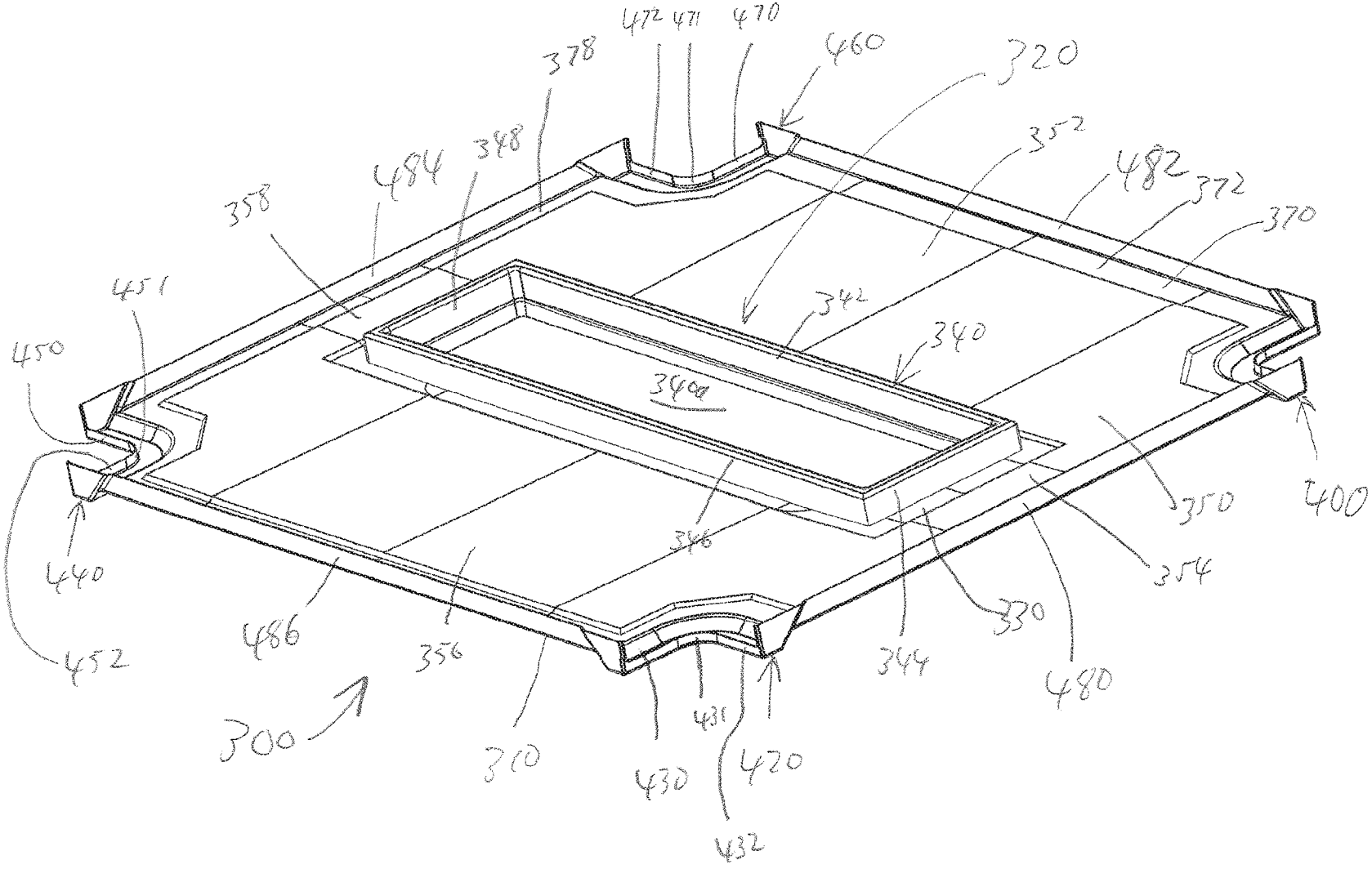
FIG. 12 is an enlarged bottom perspective view of the top wall assembly removed from the rest of the bulk material shipping container of FIG. 1.
Figure 13:
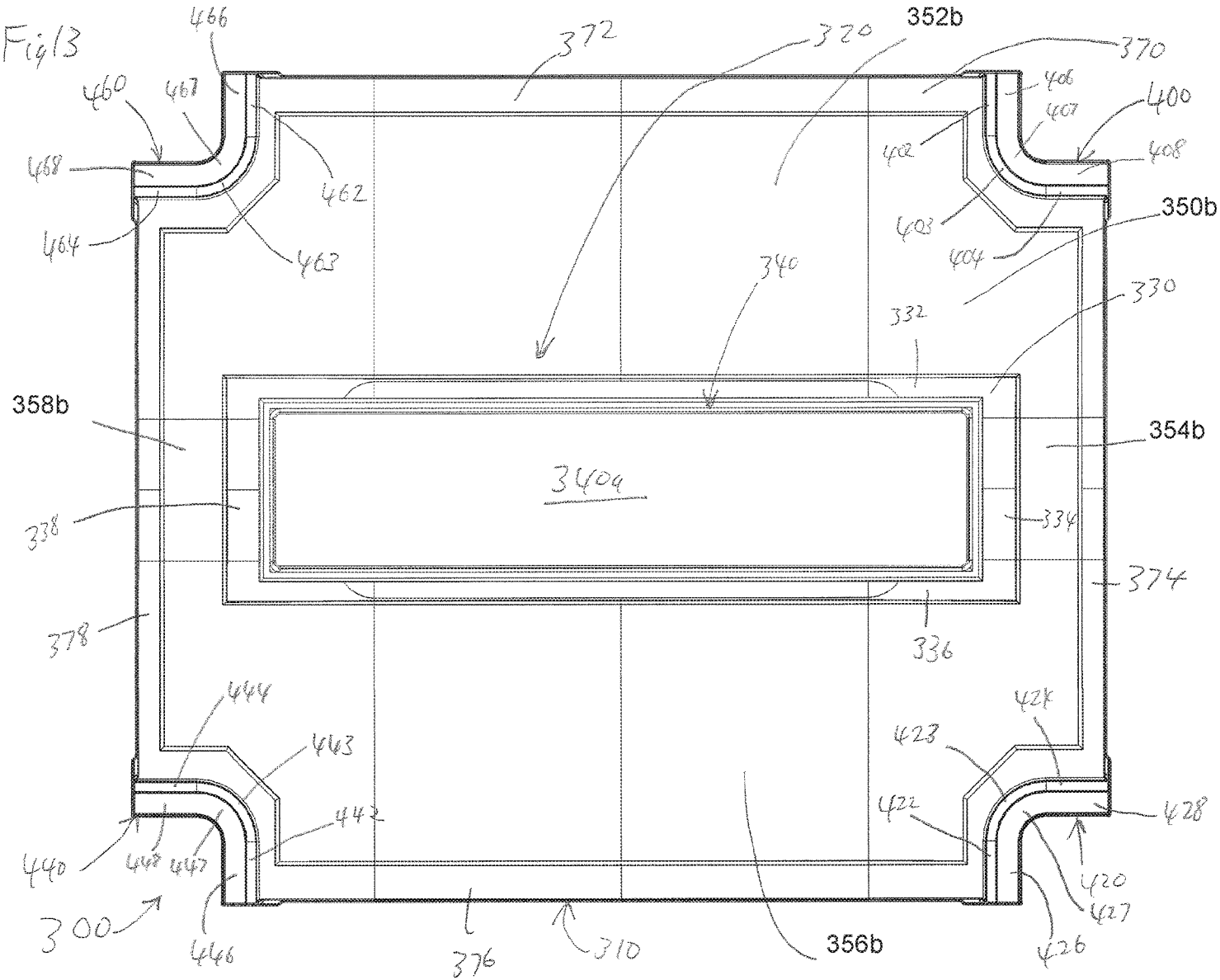
FIG. 13 is an enlarged bottom view of the top wall assembly removed from the rest of the bulk material shipping container of FIG. 1.
Figure 14:
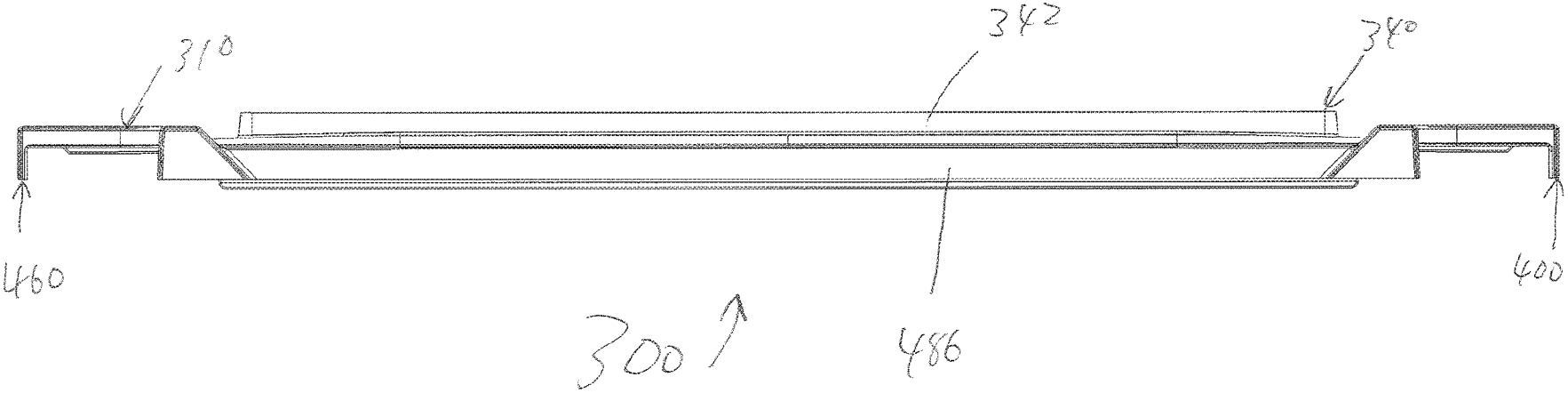
FIG. 14 is an enlarged front view of the top wall assembly removed from the rest of the bulk material shipping container of FIG. 1.
Figure 15:
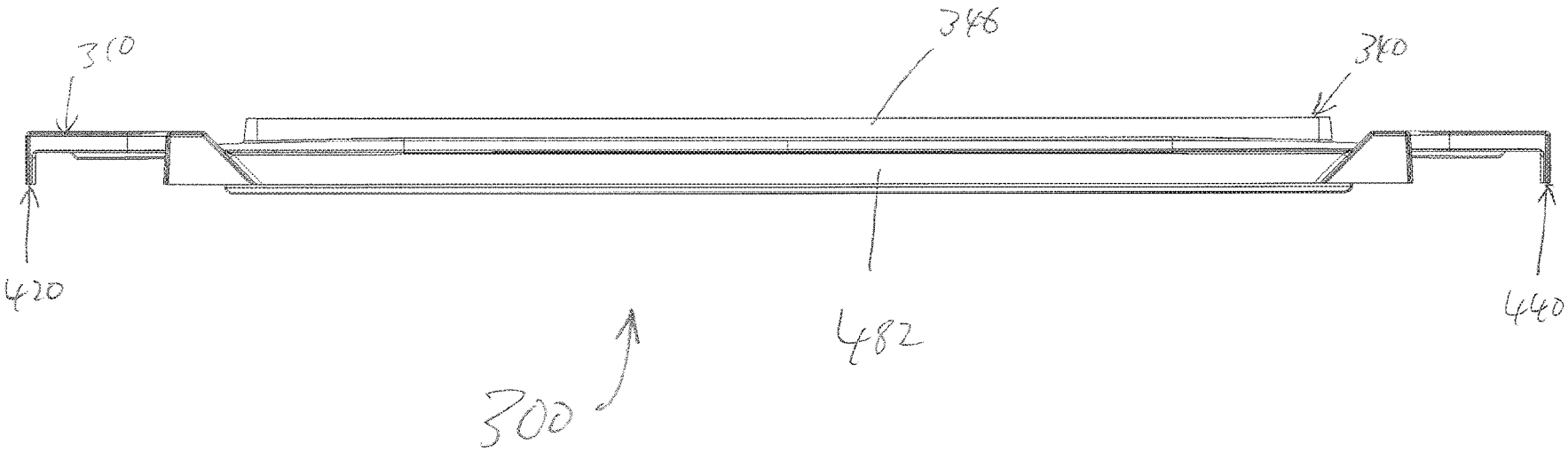
FIG. 15 is an enlarged rear view of the top wall assembly removed from the rest of the bulk material shipping container of FIG. 1.
Figure 16:
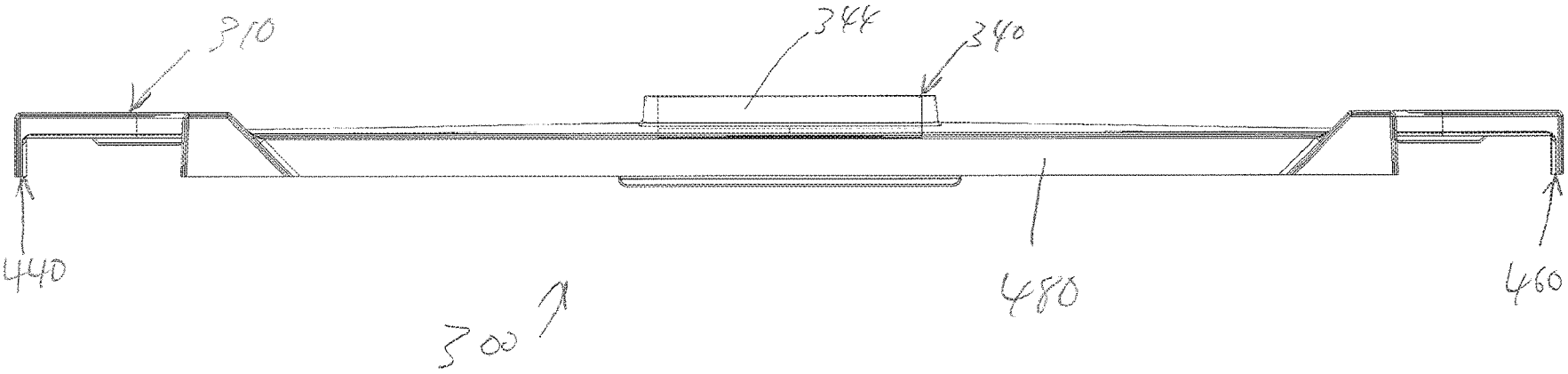
FIG. 16 is an enlarged right side view of the top wall assembly removed from the rest of the bulk material shipping container of FIG. 1.
Figure 17:
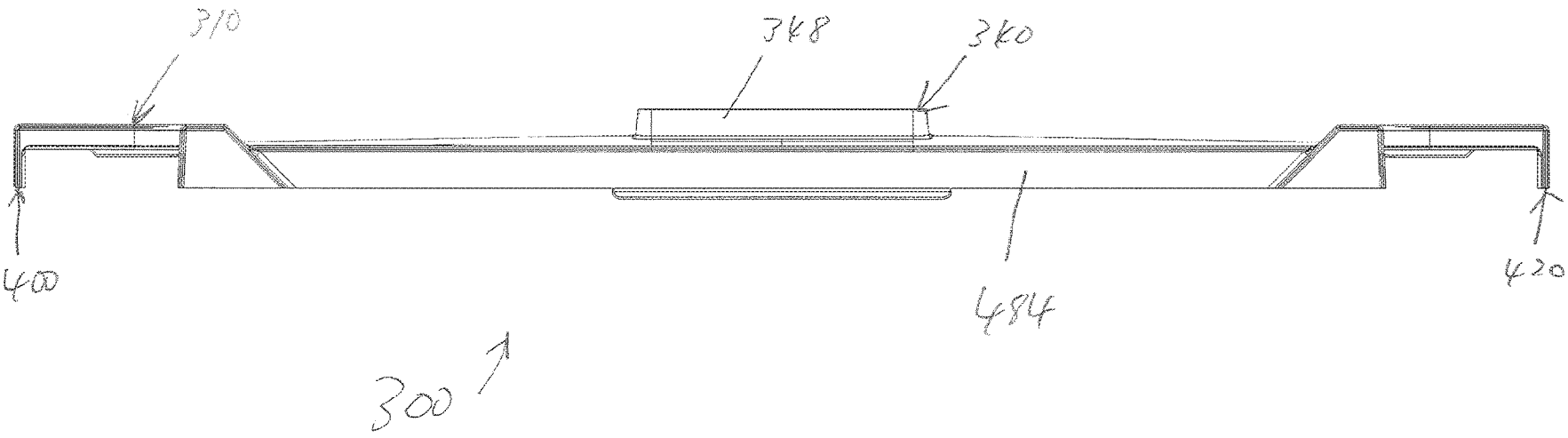
FIG. 17 is an enlarged left side view of the top wall assembly removed from the rest of the bulk material shipping container of FIG. 1.

The example material unloading assembly 800 of the bulk material shipping container 50 of the present disclosure is indicated by numeral 800 but not fully illustrated in FIGS. 8 and 9. The material unloading assembly 800 generally includes: (a) a gate movement assembly (not shown); and (b) a gate assembly (not shown). The gate assembly is configured to move on and with respect to the gate movement assembly to be in a closed position to prevent the release of loose materials held in the compartment 200, and to move to a plurality of different partially open positions and to a fully opened position to enable the release of loose materials held in the compartment 200. Example material unloading assemblies for such containers of the present disclosure are described in U.S. Pat. No. 8,887,914 and U.S. Published Patent Application No. 2018/0002066. It should be appreciated that the material unloading assembly may be in other suitable forms in accordance with the present disclosure. Thus, the material unloading assembly 800 is not described in further detail herein for brevity.

Various parts of the illustrated example compartment 200 of the shipping container 50 of the present disclosure are generally illustrated in FIGS. 1 to 10. The compartment 200 defines an interior chamber or material holding area 202 (as indicated in FIG. 9) configured to receive, hold, and release loose materials (not shown). The compartment 200 generally includes: (1) a first upright corner assembly 210 (including a bottom corner, upright corner members, and top corner); (2) a second upright corner assembly 212 (including a bottom corner, upright corner members, and top corner); (3) a third upright corner assembly 214 (including a bottom corner, upright corner members, and top corner); (4) a fourth upright corner assembly 216 (including a bottom corner, upright corner members, and top corner); (5) an interior bottom wall assembly (not shown); (6) an interior bottom wall support assembly (not shown); (7) an exterior front wall assembly 220; (8) an exterior first or right side wall assembly 222; (9) an exterior rear wall assembly 224; (10) an exterior second or left side wall assembly 226; (11) the top wall assembly 300; and (12) a material release opening or chute (not shown) defined by the interior bottom wall assembly. In this illustrated embodiment, the first upright corner assembly 210, the second upright corner assembly 212, the third upright corner assembly 214 and the fourth upright corner assembly 216 are all formed from steel and suitably connected by fasteners or welding to provide suitable structural strength and rigidity. However, it should be appreciated that in alternative embodiments of the present disclosure, various parts of the compartment 200 can be made from other suitably strong materials (such as wood, plastic, or composite or fiber glass materials), and that two or more parts thereof can be suitably connected in other manners. Example material compartments for such containers of the present disclosure are described in U.S. Pat. No. 8,887,914 and U.S. Published Patent Application No. 2018/0002066. It should be appreciated that the compartment may be in other suitable forms in accordance with the present disclosure. Thus, the compartment (except for the top wall assembly 300) is not described in further detail herein for brevity.

As best shown in more detail in FIGS. 10 to 19, the illustrated example top wall assembly 300 of the compartment 200 of the container 50 includes: (1) a molded unitary or one-piece outer structure 310; and (2) a relatively lightweight relatively strong inner reinforcing structure 600 encapsulated in the molded unitary or one-piece outer structure 310. The outer structure 310 defines an interior cavity 602 in which the inner reinforcing structure 600 is positioned.

The outer structure 310 of the top wall assembly 300 includes a horizontally or substantially horizontally extending base 320 including: (1) an inner section 330; (2) a reinforced central section 350 surrounding the inner section 330 and defining the interior cavity 602 between a first (top) wall 350*t* and a second (bottom) wall 350*b*; and (3) an outer section 370 surrounding the central section 350. The outer structure 310 of the top wall assembly 300 includes: (1) four somewhat L-shaped partially raised corner sections 400, 420, 440, and 460 extending from the four respective corners of the outer section 370; and (2) four outer lips 480, 482, 484, and 486 extending downwardly from the four respective outer panels of the outer section 370.

More specifically, the inner section 330 of the outer structure 310 of the top wall assembly 300 includes: (1) a front panel 332; (2) a rear panel 336 spaced apart from the front panel 332; (3) a first side panel 334 connecting the front panel 332 and the rear panel 336; (4) a second side panel 338 connecting the front panel 332 and the rear panel 336 and spaced apart from the first side panel 334; and (5) an inner lip 340 that is connected to and that extends upwardly from the front panel 332, the rear panel 336, the first side panel 334, and the second side panel 338. Each of the front panel 332, the rear panel 336, the first side panel 334, and the second side panel 338 have respective top and bottom surfaces (not labeled). The inner lip 340 defines a central material loading opening 340*a* for the compartment 200 of the container 50, and includes: (1) a front wall 342; (2) a rear wall 346 spaced apart from the front wall 342; (3) a first side wall 344 connecting the front wall 342 and the rear wall 346; and (4) a second side wall 348 connecting the front wall 342 and the rear wall 346 and spaced apart from the first side wall 344. The upwardly extending inner lip 340 is configured to be engaged by and sealed by the hatch assembly 910 of the material loading assembly 900 described below. The top wall assembly 300 thus defines a rectangular material receipt or loading opening 340*a* that enables loose materials to flow into the compartment 200 when the hatch assembly 910 of the material loading assembly 900 is opened.

The central reinforced section 350 of the outer structure 310 of the top wall assembly 300 includes: (1) a front panel 352; (2) a rear panel 356 spaced apart from the front panel 352; (3) a first side panel 354 connecting the front panel 352 and the rear panel 356; and (4) a second side panel 358 connecting the front panel 352 and the rear panel 356 and spaced apart from the first side panel 354. The front panel 352 extends from the front panel 332, the rear panel 356 extends from the rear panel 336, the first side panel 334 extends from the first side panel 334, and the second side panel 358 extends from the second side panel 338 such that the front panel 352, the rear panel 356, the first side panel 354, and the second side panel 358 surrounds the inner section 330 and specifically respectively surrounds the front panel 332, the rear panel 336, the first side panel 334, and the second side panel 338. Each of the front panel 352, the rear panel 356, the first side panel 354, and the second side panel 358 have respective top and bottom walls collectively referred to as first (top) wall 350*t* and second (bottom) wall 350*b*.

Figure 18:
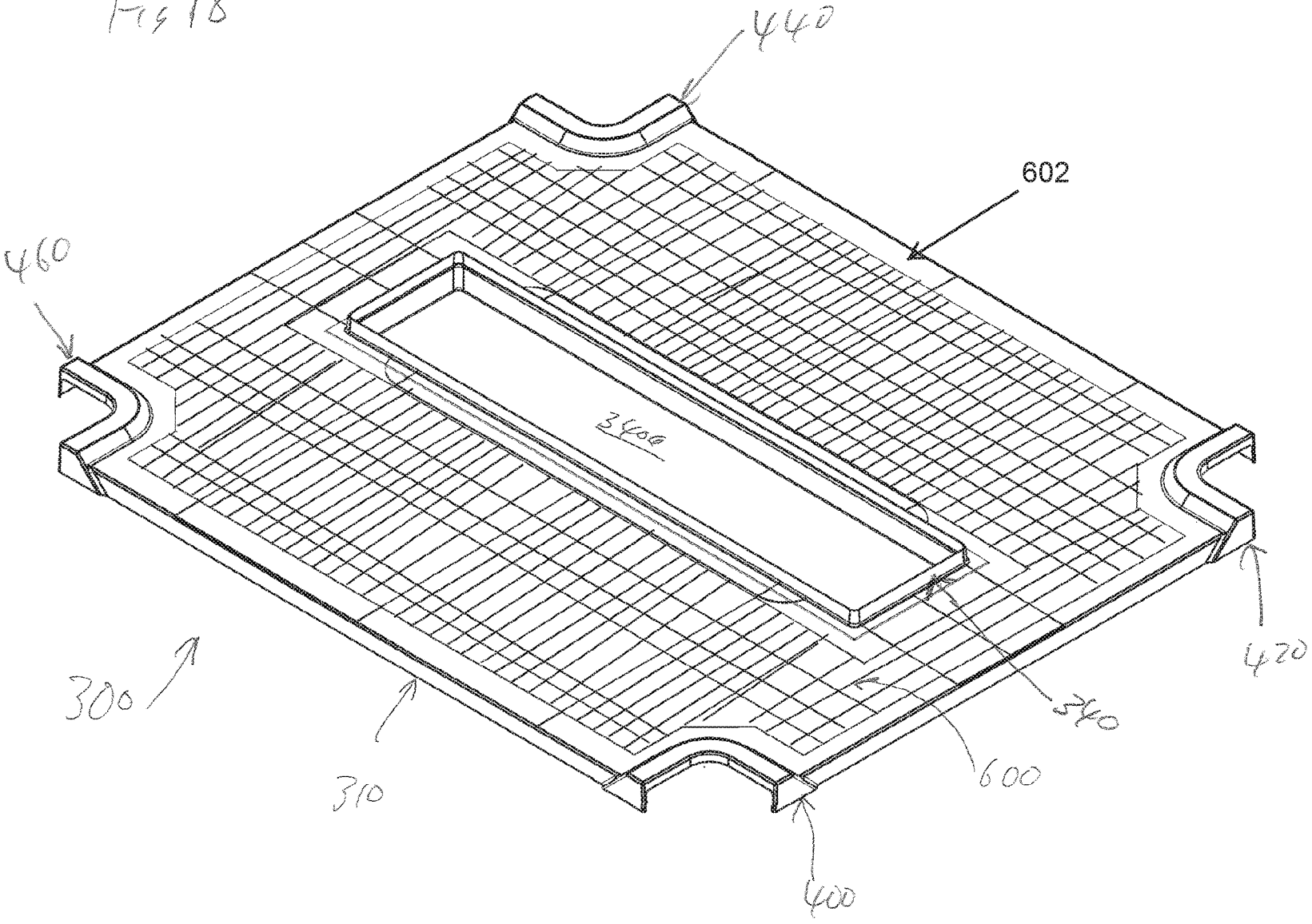
FIG. 18 is an enlarged fragmentary top perspective view of the top wall assembly removed from the rest of the bulk material shipping container of FIG. 1, and showing the inner reinforcing structure in the interior cavity.
Figure 19:
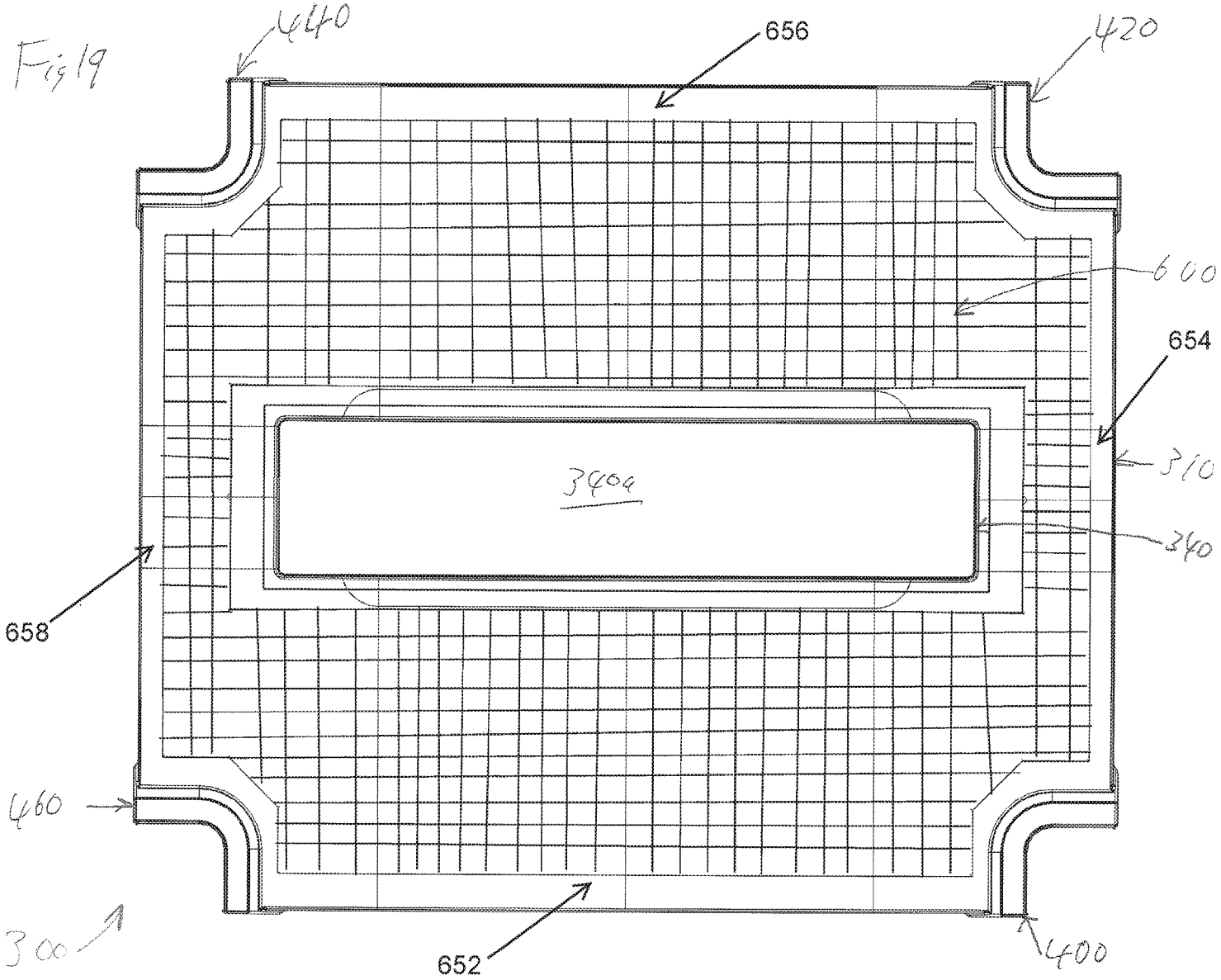
FIG. 19 is a top view of the top wall assembly removed from the rest of the bulk material shipping container of FIG. 1, and showing the inner reinforcing structure in the interior cavity.

In this illustrated example embodiment, the front panel 352, the rear panel 356, the first side panel 354, and the second side panel 358 are reinforced by a plurality of suitable inner reinforcing members 600 diagrammatically shown in FIGS. 18 and 19. In this illustrated example embodiment, the front panel 352 includes spaced apart first (top) and second (bottom) walls 352*t*, 352*b* that define a front interior cavity 652, the rear panel 356 includes spaced apart first (top) and second (bottom) walls 356*t*, 356*b* that define a rear interior cavity 656, the first side panel 354 includes spaced apart first (top) and second (bottom) walls 354*t*, 354*b* that define a first side interior cavity 654, and the second side panel 358 includes spaced apart first (top) and second (bottom) walls 358*t*, 358*b* that define a second side interior cavity 658. In this illustrated example embodiment, the front interior cavity 652, the rear interior cavity 656, the first side interior cavity 654, and the second side interior cavity 658 are all connected. In this illustrated example embodiment, the front interior cavity 652, the rear interior cavity 656, the first side interior cavity 654, and the second side interior cavity 658 are each partially or fully filled with a relatively light weight relatively strong inner reinforcing material 600. In this illustrated example embodiment, the reinforcing material 600 is a lightweight wood such as a balsa wood. It should be appreciated that other suitable reinforcing materials may be employed in accordance with the present disclosure. It should be appreciated that the reinforcing material can be arranged in any suitable manner in the connected interior cavities in accordance with the present disclosure. It should be appreciated that two or more of the interior cavities may be separate cavities in accordance with the present disclosure.

The outer section 370 of the outer structure 310 of the top wall assembly 300 includes: (1) a front panel 372; (2) a rear panel 376 spaced apart from the front panel 372; (3) a first side panel 374 connecting the front panel 372 and the rear panel 376; and (4) a second side panel 378 connecting the front panel 372 and the rear panel 376 and spaced apart from the first side panel 374. The front panel 372 extends from the front panel 352, the rear panel 376 extends from the rear panel 356, the first side panel 374 extends from the first side panel 354, and the second side panel 378 extends from the second side panel 358 such that the front panel 372, the rear panel 376, the first side panel 374, and the second side panel 378 surrounds the inner section 350 and more specifically respectively surround the front panel 352, the rear panel 356, the first side panel 354, and the second side panel 358. Each of the front panel 372, the rear panel 376, the first side panel 374, and the second side panel 378 have respective top and bottom surfaces (not labeled).

The four somewhat L-shaped partially raised corner sections 400, 420, 440, and 460 of the outer structure 310 of the top wall assembly 300 are identical in this illustrated example embodiment.

Corner section 400 includes: (1) first and second upwardly and outwardly extending inner walls 402 and 404 connected by a curved inner wall 403; (2) first and second outwardly extending top walls 406 and 408 connected by a curved top wall 407; (3) first and second downwardly extending outer walls 410 and 412 connected by a downwardly extending curved outer wall 411; and (4) first and second downwardly extending end walls 414 and 416. Each of the upwardly and outwardly extending inner walls 402, 403 and 404, the outwardly extending top walls 406, 407 and 408, the downwardly extending outer walls 410, 411 and 412 have top and bottom surfaces (not labeled). The first and second downwardly extending end walls 414 and 416 have inner and outer surfaces (not labeled).

The first inner wall 402 is connected to the outer section 370, the first top wall 406 is connected to the first inner wall 402, and the first outer wall 410 is connected to the first top wall 406. The second inner wall 404 is connected to the outer section 370, the second top wall 408 is connected to the second inner wall 404, and the second outer wall 412 is connected to the second top wall 408. The curved inner wall 403 is connected to the outer section 370, the curved top wall 407 is connected to the curved inner wall 403, and the curved outer wall 411 is connected to the curved top wall 407. The first end wall 414 is connected to the first inner wall 402, the first top wall 406, and the first outer wall 410. The second end wall 416 is connected to the second inner wall 404, the second top wall 408, and the second outer wall 412. Each of these walls includes respective inner and outer surfaces (not labeled). Each of these walls co-act to form the corner section 402 such that the corner section 402 is configured to be mounted to and supported by the first upright corner assembly 212.

Likewise, corner section 420 includes: (1) first and second upwardly and outwardly extending inner walls 422 and 424 connected by a curved inner wall 423; (2) first and second outwardly extending top walls 426 and 428 connected by a curved top wall 427; (3) first and second downwardly extending outer walls 430 and 432 connected by a downwardly extending curved outer wall 431; and (4) first and second downwardly extending end walls 434 and 436. Each of the upwardly and outwardly extending inner walls 422, 423 and 424, the outwardly extending top walls 426, 427 and 428, the downwardly extending outer walls 430 and 432 have top and bottom surfaces (not labeled). The downwardly extending end walls 434, 435 and 436 have inner and outer surfaces (not labeled).

The first inner wall 422 is connected to the outer section 370, the first top wall 426 is connected to the first inner wall 422, and the first outer wall 430 is connected to the first top wall 426. The second inner wall 424 is connected to the outer section 370, the second top wall 428 is connected to the second inner wall 424, and the second outer wall 432 is connected to the second top wall 428. The curved inner wall 423 is connected to the outer section 370, the curved top wall 427 is connected to the curved inner wall 423, and the curved outer wall 431 is connected to the curved top wall 427. The first end wall 434 is connected to the first inner wall 422, the first top wall 426, and the first outer wall 430. The second end wall 436 is connected to the second inner wall 424, the second top wall 428, and the second outer wall 432. Each of these walls includes respective inner and outer surfaces (not labeled). Each of these walls co-act to form the corner section 420 such that the corner section 420 is configured to be mounted on and supported by the second upright corner assembly 214.

Likewise, corner section 440 includes: (1) first and second upwardly and outwardly extending inner walls 442 and 444 connected by a curved inner wall 443; (2) first and second outwardly extending top walls 446 and 448 connected by a curved top wall 447; (3) first and second downwardly extending outer walls 450 and 452 connected by a downwardly extending curved outer wall 451; and (4) first and second downwardly extending end walls 454 and 456. Each of the upwardly and outwardly extending inner walls 452, 453 and 454, the outwardly extending top walls 456, 457 and 458, the downwardly extending outer walls 460 and 462 have top and bottom surfaces (not labeled). The downwardly extending end walls 454, 455 and 456 have inner and outer surfaces (not labeled).

The first inner wall 442 is connected to the outer section 370, the first top wall 446 is connected to the first inner wall 442, and the first outer wall 450 is connected to the first top wall 446. The second inner wall 444 is connected to the outer section 370, the second top wall 448 is connected to the second inner wall 444, and the second outer wall 452 is connected to the second top wall 448. The curved inner wall 443 is connected to the outer section 370, the curved top wall 447 is connected to the curved inner wall 443, and the curved outer wall 451 is connected to the curved top wall 447. The first end wall 454 is connected to the first inner wall 442, the first top wall 446, and the first outer wall 450. The second end wall 456 is connected to the second inner wall 444, the second top wall 448, and the second outer wall 452. Each of these walls includes respective inner and outer surfaces (not labeled). Each of these walls co-act to form the corner section 440 such that the corner section 440 is configured to be mounted on and supported by the third upright corner assembly 216.

Likewise, corner section 460 includes: (1) first and second upwardly and outwardly extending inner walls 462 and 464 connected by a curved inner wall 463; (2) first and second outwardly extending top walls 466 and 468 connected by a curved top wall 467; (3) first and second downwardly extending outer walls 470 and 472 connected by a downwardly extending curved outer wall 471; and (4) first and second downwardly extending end walls 474 and 476. Each of the upwardly and outwardly extending inner walls 472, 473 and 474, the outwardly extending top walls 476, 477 and 478, the downwardly extending outer walls 480, 481 and 482 have top and bottom surfaces (not labeled). The first and second downwardly extending end walls 484 and 486 have inner and outer surfaces (not labeled).

The first inner wall 462 is connected to the outer section 370, the first top wall 466 is connected to the first inner wall 462, and the first outer wall 470 is connected to the first top wall 466. The second inner wall 464 is connected to the outer section 370, the second top wall 468 is connected to the second inner wall 464, and the second outer wall 472 is connected to the second top wall 468. The curved inner wall 463 is connected to the outer section 370, the curved top wall 467 is connected to the curved inner wall 463, and the curved outer wall 471 is connected to the curved top wall 467. The first end wall 474 is connected to the first inner wall 462, the first top wall 466, and the first outer wall 470. The second end wall 446 is connected to the second inner wall 444, the second top wall 448, and the second outer wall 472. Each of these walls includes respective inner and outer surfaces (not labeled). Each of these walls co-act to form the corner section 460 such that the corner section 460 is configured to be mounted on and supported by the fourth upright corner assembly 418.

Each of the corner sections 400, 420, 440, and 460 are configured to: (1) direct water (such as from precipitation) away from the corner and off of the container 100; (2) prevent water (and other contaminants) from entering the compartment; (3) provide for easier, simpler, and quicker attachment of the top wall assembly to the rest of the container; and (4) add strength and rigidity to the corner sections of the compartment and the entire container.

The four downwardly extending outer lips 482, 484, 486, and 488 of the outer structure 310 of the top wall assembly 300 are connected to the outer section 370 of the outer structure 310. More specifically, (1) outer lip 482 is connected to and extends downwardly from the front panel 372; (2) outer lip 486 is connected to and extends downwardly from rear panel 376; (3) outer lip 484 is connected to and extends downwardly from first side panel 374; and (4) outer lip 488 is connected to and extends downwardly from second side panel 378.

Each of the four downwardly extending outer lips 480, 482, 484, and 486 are configured to: (1) prevent water from entering the compartment; and (2) provide for easier, simpler, and quicker attachment of the top wall assembly to the rest of the container. Specifically, for attachment purposes, suitable holes are formed in each of the outer lips 480, 482, 484, and 486, and suitable fasteners (such as nuts, washers, and bolts) are employed to attached each of the respective outer lips 480, 482, 484, and 486 to respective top wall assembly supporters (not shown).

In this illustrated embodiment, the top wall 310 of the top wall assembly 300 (besides the inner reinforcing structure) is made of fiberglass to: (1) provide a relatively light-weight top wall; (2) facilitate ease of attachment or connection to the rest of the compartment of the container; (3) provide structural strength and rigidity; (4) facilitate ease of cleaning; (5) prevent rusting; (6) minimize overall weight of the container; and (7) prevent contamination. However, it should be appreciated that in alternative embodiments, one or more of these components can be made from other suitable materials and connected in any suitable manner.

The material loading assembly 900 of this illustrated example embodiment of the shipping container 50 of the present disclosure is generally illustrated in FIGS. 1 to 9. The material loading assembly 900 generally includes: (1) a hatch assembly 910; and (2) a hatch movement and locking assembly 950. The hatch assembly 910 is configured to be in a closed position (as shown in FIGS. 1, 2, 3, 4, 5, 6, 7, 8, and 9) to prevent loose materials and contaminants from entering the compartment 200 through the opening **340*a* in the top wall 310 of the top wall assembly 300 of the compartment 200, and to move to a plurality of different partially open positions (not shown) and to a fully opened position (not shown) to enable loose materials to be loaded into the compartment 200 through the opening 340*a* in the top wall 310 of the top wall assembly 300 of the compartment 200**.

In this illustrated example embodiment, the hatch assembly 910 includes a top wall (not labeled), a front wall (not labeled) connected to and extending downwardly from the top wall, a back wall (not labeled) connected to and extending downwardly from the top wall, a right side wall (not labeled) connected to and extending downwardly from the top wall, and a left side wall (not labeled) connected to and extending downwardly from the top wall. In this illustrated example embodiment, the hatch movement and locking assembly 950 includes a first hinge assembly (not labeled), a second hinge assembly (not labeled), a third hinge assembly (not labeled), and a locking assembly (not labeled). In this illustrated example embodiment, the first, second and third hinge assemblies are suitably connected to the top wall 310 and the top wall site hatch assembly 910. In this illustrated embodiment, the configuration, arrangement, and attachment of the hatch assembly 910 and the hatch movement and locking assembly 950 provide material contamination prevention and secure access to the compartment 200.

It should be appreciated that any suitable locking mechanism (not shown) may be employed in accordance with the present disclosure to lock the material loading assembly.

It should further be appreciated that the top wall assembly of the present disclosure can be suitably coated (such as by painting with a clear or colored protective coating). It should be appreciated that such coating may include a UV protective agent.

It should also be appreciated that one or more suitable vents (not shown) can be formed in or attached to the top wall assembly in accordance with the present disclosure.

It should be appreciated that the present disclosure contemplates the elimination or reduction of sharp edges in the compartment and that any sharp edges can be curved or formed with a suitable radius.

It should also be appreciated that the present disclosure contemplates the use of foam, tape, or other materials in connection with the corner assemblies for sealing purposes.

It should be appreciated from the above, that various embodiments of the present disclosure provide a bulk material shipping container comprising: a compartment including a top wall assembly, the top wall assembly including a molded unitary outer structure and an inner reinforcing structure; a material loading assembly connected to and supported by the top wall assembly; and a material unloading assembly at a bottom portion of the compartment. In various such embodiments, the top wall assembly mates with a first upper corner assembly, a second upper corner assembly, a third upper corner assembly, and a fourth upper corner assembly of the compartment. In various such embodiments, the outer structure includes an inner section, a central section surrounding the inner section and defining an interior cavity in which the inner reinforcing structure is positioned, and an outer section surrounding the central section. In various such embodiments, the outer structure includes four somewhat L-shaped partially raised corner sections extending from four respective corners of the outer section. In various such embodiments, the outer structure includes four outer lips extending downwardly from the outer section. In various such embodiments, the inner reinforcing structure includes wood. In various such embodiments, the inner reinforcing structure includes balsa wood.

It should also be appreciated from the above, that various embodiments of the present disclosure provide a bulk material shipping container comprising: a compartment including a top wall assembly, the top wall assembly including a molded unitary outer structure and an inner reinforcing structure, the top wall assembly mating with a first upper corner assembly, a second upper corner assembly, a third upper corner assembly, and a fourth upper corner assembly of the compartment, the outer structure including an inner section, a central section surrounding the inner section and defining an interior cavity in which the inner reinforcing structure is positioned, and an outer section surrounding the central section, the outer structure including four somewhat L-shaped partially raised corner sections extending from four respective corners of the outer section, the outer structure including four outer lips extending downwardly from the outer section; a material loading assembly connected to and supported by the top wall assembly; and a material unloading assembly at a bottom portion of the compartment. In various such embodiments, the inner reinforcing structure includes wood. In various such embodiments, the inner reinforcing structure includes balsa wood.

It should also be appreciated from the above, that various embodiments of the present disclosure provide a bulk material shipping container top wall assembly comprising: a molded unitary outer structure; and an inner reinforcing structure. In various such embodiments, the outer structure is configured to mate with a first upper corner assembly, a second upper corner assembly, a third upper corner assembly, and a fourth upper corner assembly of a compartment of a bulk material shipping container. In various such embodiments, the outer structure includes an inner section, a central section surrounding the inner section and defining an interior cavity in which the inner reinforcing structure is positioned, and an outer section surrounding the central section. In various such embodiments, the outer structure includes four somewhat L-shaped partially raised corner sections extending from four respective corners of the outer section. In various such embodiments, the outer structure includes four outer lips extending downwardly from the outer section. In various such embodiments, the inner reinforcing structure includes wood. In various such embodiments, the inner reinforcing structure includes balsa wood.

It should also be appreciated from the above, that various embodiments of the present disclosure provide a bulk material shipping container top wall assembly comprising: a molded unitary outer structure including an inner section, a central section surrounding the inner section and defining an interior cavity, and an outer section surrounding the central section, the outer structure including four somewhat L-shaped partially raised corner sections extending from four respective corners of the outer section, the outer structure including four outer lips extending downwardly from the outer section; and an inner reinforcing structure positioned in the interior cavity. In various such embodiments, the inner reinforcing structure includes wood. In various such embodiments, the inner reinforcing structure includes balsa wood.

It should be understood that modifications and variations may be effected without departing from the scope of the novel concepts of the present disclosure, and it should be understood that this application is to be limited only by the scope of the appended claims.

The invention is claimed as follows:

1. A bulk material shipping container comprising:

a compartment defining an interior volume and including a top wall assembly enclosing the interior volume, the top wall assembly including:

a molded outer structure having an inner section with an opening formed therethrough, an upwardly extending inner lip extending around a perimeter of the opening, a central section surrounding the inner section including a top wall and a bottom wall spaced apart from the top wall to form an interior cavity, and an outer section surrounding the central section, wherein an inner reinforcing structure is positioned within the interior cavity and encapsulated in the central section;

a material loading assembly configured to engage with and be sealed by the upwardly extending inner lip, wherein the material loading assembly is connected to the top wall of the top wall assembly using a hatch movement and locking assembly including one or more hinge assemblies; and a material unloading assembly at a bottom portion of the compartment.

2. The bulk material shipping container of claim 1, wherein the top wall assembly mates with a first upper corner assembly, a second upper corner assembly, a third upper corner assembly, and a fourth upper corner assembly of the compartment.

3. The bulk material shipping container of claim 1, wherein the outer structure includes four L-shaped partially raised corner sections extending from four respective corners of the outer section.

4. The bulk material shipping container of claim 3, wherein the outer structure includes four outer lips extending downwardly from the outer section.

5. The bulk material shipping container of claim 1, wherein the inner reinforcing structure includes wood.

6. The bulk material shipping container of claim 1, wherein the inner reinforcing structure includes balsawood.

7. The bulk material shipping container of claim 1, wherein the outer structure comprises an assembly of molded plastic panels forming a unitary outer structure.

8. A bulk material shipping container comprising:

a compartment defining an interior volume and including a top wall assembly enclosing the interior volume, the top wall assembly including:

a molded outer structure;

an inner reinforcing structure encapsulated in the outer structure, wherein the top wall assembly mates with a first upper corner assembly, a second upper corner assembly, a third upper corner assembly, and a fourth upper corner assembly of the compartment, wherein the outer structure includes an inner section, a central section surrounding the inner section and including a top wall and a bottom wall spaced apart from the top wall defining an interior cavity in which the inner reinforcing structure is positioned, and an outer section surrounding the central section, the outer structure including four L-shaped partially raised corner sections extending from four respective corners of the outer section, wherein the outer structure including four outer lips extending downwardly from the outer section; and an opening formed into the molded outer structure; and an upwardly extending lip extending around a perimeter of the opening;

a material loading assembly configured to engage with and be sealed by the upwardly extending inner lip, wherein the material loading assembly is connected to the top wall of the top wall assembly using a hatch movement and locking assembly including one or more hinge assemblies; and a material unloading assembly at a bottom portion of the compartment.

9. The bulk material shipping container of claim 8, wherein the inner reinforcing structure includes wood.

10. The bulk material shipping container of claim 8, wherein the inner reinforcing structure includes balsawood.

11. A bulk material shipping container top wall assembly comprising:

a molded outer structure having an inner section with an opening formed therethrough;

an upwardly extending inner lip extending around a perimeter of the opening;

a central section surrounding the inner section including a top wall and a bottom wall spaced apart from the top wall to form an interior cavity;

a material loading assembly configured to engage with and be sealed by the upwardly extending inner lip, wherein the material loading assembly is connected to the top wall using a hatch movement and locking assembly including one or more hinge assemblies;

an outer section surrounding the central section; and an inner reinforcing structure positioned within the interior cavity and encapsulated in the central section.

12. The bulk material shipping container top wall assembly of claim 11, wherein the outer structure is configured to mate with a first upper corner assembly, a second upper corner assembly, a third upper corner assembly, and a fourth upper corner assembly of a compartment of a bulk material shipping container.

13. The bulk material shipping container top wall assembly of claim 11, wherein the outer structure includes four L-shaped partially raised corner sections extending from four respective corners of the outer section.

14. The bulk material shipping container top wall assembly of claim 13, wherein the outer structure includes four outer lips extending downwardly from the outer section.

15. The bulk material shipping container top wall assembly of claim 11, wherein the inner reinforcing structure includes wood.

16. The bulk material shipping container top wall assembly of claim 11, wherein the inner reinforcing structure includes balsa wood.

17. The bulk material shipping container top wall assembly of claim 11, wherein the outer structure comprises an assembly of molded plastic panels forming a unitary outer structure.

18. A bulk material shipping container top wall assembly comprising:

a molded outer structure including an inner section, a central section surrounding the inner section and including a top wall and a bottom wall spaced apart from the top wall defining an interior cavity, and an outer section surrounding the central section, the outer structure including four L-shaped partially raised corner sections extending from four respective corners of the outer section, the outer structure including four outer lips extending downwardly from the outer section;

an opening formed into the molded outer structure; and an upwardly extending lip extending around a perimeter of the opening;

a material loading assembly configured to engage with and be sealed by the upwardly extending inner lip, wherein the material loading assembly is connected to the top wall using a hatch movement and locking assembly including one or more hinge assemblies; and an inner reinforcing structure positioned in the interior cavity and encapsulated in the central section.

19. The bulk material shipping container top wall assembly of claim 18, wherein the inner reinforcing structure includes wood.

20. The bulk material shipping container top wall assembly of claim 18, wherein the inner reinforcing structure includes balsa wood.

* * * * *